US010190290B2

(12) United States Patent
Gandy et al.

(10) Patent No.: US 10,190,290 B2
(45) Date of Patent: Jan. 29, 2019

(54) LOCK ASSEMBLY FOR A WEAR MEMBER

(71) Applicant: Bradken Resources Pty Limited, Mayfield West, NSW (AU)

(72) Inventors: David James Gandy, Adamstown (AU); Geoffrey Lodge, Newcastle (AU)

(73) Assignee: Bradken Resources Pty Limited, Mayfield West, NSW (AU)

( * ) Notice: Subject to any disclaimer, the term of this patent is extended or adjusted under 35 U.S.C. 154(b) by 0 days.

(21) Appl. No.: 15/104,496

(22) PCT Filed: Dec. 19, 2014

(86) PCT No.: PCT/AU2014/001149
§ 371 (c)(1),
(2) Date: Jun. 14, 2016

(87) PCT Pub. No.: WO2015/089565
PCT Pub. Date: Jun. 25, 2015

(65) Prior Publication Data

US 2016/0356024 A1 Dec. 8, 2016

(30) Foreign Application Priority Data

Dec. 20, 2013 (AU) ..... 2013905010

(51) Int. Cl.
*E02F 9/28* (2006.01)
*E02F 3/40* (2006.01)
*E02F 3/60* (2006.01)

(52) U.S. Cl.
CPC ..... *E02F 9/2825* (2013.01); *E02F 9/2833* (2013.01); *E02F 9/2841* (2013.01); *E02F 9/2883* (2013.01)

(58) Field of Classification Search
CPC ..... E02F 9/2833; E02F 9/2816; E02F 9/2828; E02F 9/2825; E02F 9/2866; E02F 3/36;
(Continued)

(56) References Cited

U.S. PATENT DOCUMENTS 612,489 A * 10/1898 Dean ..... F16D 1/096 403/370
4,057,294 A 11/1977 Krekeler
(Continued)

FOREIGN PATENT DOCUMENTS

WO WO-2011/156834 12/2011

OTHER PUBLICATIONS

International Search Report dated Mar. 17, 2015, directed to International Application No. PCT/AU2014/001149; 8 pages.

*Primary Examiner* — Robert E Pezzuto
(74) *Attorney, Agent, or Firm* — Morrison & Foerster LLP

(57) ABSTRACT

A lock assembly for locking a wear member to excavation equipment, the assembly comprising first and second bodies configured to be assembled together, one body substantially positioned over the other, in an assembled condition to form a lock extending along a longitudinal axis, the first and second bodies each comprising at least one interengaging formation, the, or respective ones of the, interengaging formations on the bodies being configured to interengage when the bodies are in the assembled condition to form one or more couplings that resist lateral displacement of the bodies with respect to each other under loads applied transverse to the longitudinal axis of the assembled lock to the side of the first and second bodies.

20 Claims, 17 Drawing Sheets

(58) Field of Classification Search
CPC ..... E02F 3/80; E02F 9/2883; E02F 9/2841; F16B 2/14; F16D 1/096
USPC ..... 37/446, 452–460; 172/701.1–701.3; 403/379.4, 350, 374.3
See application file for complete search history.

(56) References Cited

U.S. PATENT DOCUMENTS

| | | | | | |
|---|---|---|---|---|---|
| 5,410,826 | A * | 5/1995 | Immel | E02F 9/2833 | 37/455 |
| 5,868,518 | A * | 2/1999 | Chesterfield | B25G 3/00 | 37/456 |
| 6,145,224 | A * | 11/2000 | Stickling | E02F 9/2825 | 37/456 |
| 7,536,811 | B2 * | 5/2009 | McClanahan | E02F 9/2833 | 172/772.5 |
| D634,605 | S * | 3/2011 | Guimaraes | D15/28 | |
| 2004/0107608 | A1 | 6/2004 | Meyers et al. | | |
| 2004/0216334 | A1 | 11/2004 | Emrich et al. | | |
| 2007/0293074 | A1 | 12/2007 | McClanahan | | |
| 2008/0092413 | A1 | 4/2008 | McClanahan et al. | | |
| 2009/0304442 | A1 | 12/2009 | Dennis et al. | | |
| 2011/0314709 | A1 | 12/2011 | Swinscoe | | |

* cited by examiner

LOCK ASSEMBLY FOR A WEAR MEMBER

CROSS-REFERENCE TO RELATED APPLICATIONS

This application is a national phase filing under 35 U.S.C. § 371 of International Application No. PCT/AU2014/001149, filed Dec. 19, 2014, and which claims priority to Australian Patent Application No. 2013905010, filed on Dec. 20, 2013, the contents of which prior applications are incorporated herein by reference.

FIELD OF THE INVENTION

The present disclosure relates to lock assemblies for locking a wear member to excavation equipment. The present disclosure also relates to wear assemblies for attachment to excavation equipment. The present disclosure further relates to methods of locking a wear member to excavation equipment.

BACKGROUND OF THE INVENTION

Excavation teeth are provided on the digging edge of various pieces of excavation equipment such as the buckets of front end loaders. Each excavation tooth is formed of a number of tooth members, commonly a point and an adapter and one or more locks for locking the tooth members together. The adapter is typically fitted to the excavation equipment and the point fits over a nose of the adapter and is retained in place by the lock. In some instances one or more intermediate tooth members may also be included between the point and the adapter. For ease of description it is to be understood that, unless the context requires otherwise, the term "adapter" used in this specification includes both the adapter arranged to be fitted to the excavation equipment or, if one or more intermediate tooth members are provided, to that intermediate tooth member(s) or to the combination of the adapter and the intermediate tooth member(s).

Also, unless the context requires otherwise, the term "nose" used in this specification is a projecting portion to which a tooth member of the excavation tooth is mounted and includes a projecting portion on the excavation equipment to which the adapter is mounted, a projecting part on the adapter to which the point or intermediate tooth member is mounted and a projecting part on the intermediate tooth member to which the point or other tooth members are mounted.

The reason that the excavation tooth is formed of a number of parts is to avoid having to discard the entire tooth when only a part of the tooth, in particular the ground engaging part of the tooth (i.e. the point) is worn or broken.

Excavation equipment may also be provided with shrouds that fit over the digging edge to protect the edge from wear and are locked in place using some form of locking arrangement. Shrouds may be provided in between the excavation teeth attached to the digging edge, or where teeth are not present, shrouds may be provided across the digging edge.

The tooth members (including the adaptors and points) and the shrouds may all be considered to be "wear members" because they are provided on the excavation equipment to wear during use, rather than the equipment itself. The wear members, once worn, can be detached and replaced. This saves having to replace a much larger component such as a front end loader bucket or a dredging head.

Various types of locks, shrouds, points and adapters are known. However, it is always desirable to design new excavation tooth assemblies and parts thereof.

SUMMARY OF THE INVENTION

The present disclosure relates to improvements in relation to the locks used to lock the wear members to the excavation equipment.

According to one embodiment, the present disclosure provides a lock assembly for locking a wear member to excavation equipment, the assembly comprising first and second bodies configured to be assembled together, one body substantially positioned over the other, in an assembled condition to form a lock extending along a longitudinal axis, the first and second bodies each comprising at least one interengaging formation, the, or respective ones of the, interengaging formations on the bodies being configured to interengage when the bodies are in the assembled condition to form one or more couplings that resist lateral displacement of the bodies with respect to each other under loads applied transverse to the longitudinal axis of the assembled lock to the side of the first and second bodies.

According to another embodiment, the present disclosure provides a wear assembly for attachment to excavation equipment comprising:

- a wear member extending along a longitudinal axis between a forward portion and a rearward mounting portion, the wear member having a recess for receiving a lock; and
- a lock that extends along a longitudinal axis and is configured to be inserted into the recess of the wear member to lock the wear member to the excavation equipment, the lock comprising first and second bodies configured to be assembled together, one body substantially positioned over the other, in an assembled condition, the first and second bodies each comprising at least one interengaging formation, the, or respective ones of the, interengaging formations on the bodies being configured to interengage when the bodies are in the assembled condition to form one or more couplings that resist lateral displacement of the bodies with respect to each other under loads applied transverse to the longitudinal axis of the assembled lock to the side of the first and second bodies.

According to another embodiment, the present disclosure provides a lock assembly for locking a wear member to excavation equipment, the assembly comprising first and second bodies configured to be assembled together in an assembled condition to form a lock extending along a longitudinal axis, the lock adjustable between first and second configurations of the first and second bodies, wherein adjustment of the lock from the first to the second configuration comprises the first body moving with respect to the second body to extend the lock in the direction of the lock's longitudinal axis and retract the lock in a direction transverse to the lock's longitudinal axis.

According to another embodiment, the present disclosure provides a wear assembly for attachment to excavation equipment comprising:

- a wear member that extends along a longitudinal axis between a forward portion and a rearward mounting portion, the wear member having a recess for receiving a lock; and
- a lock extending along a longitudinal axis and configured to be inserted into the recess of the wear member to lock the wear member to the excavation equipment, the lock comprising first and second bodies configured to be assembled together in an assembled condition, the lock adjustable between first and second configurations of the first and second bodies, wherein adjustment of the lock from the first to the second configuration comprises the first body moving with respect to the second body to extend the lock in the direction of the lock's longitudinal axis and retract the lock in a direction transverse to the lock's longitudinal axis, said adjustment of the lock to the second configuration causing the wear member to be locked to the excavation equipment when the lock is located in the recess of the wear member.

According to another embodiment, the present disclosure provides a method of attaching a wear member to excavating equipment, the method comprising:

mounting a wear member to the excavating equipment, inserting into a recess of the wear member a lock that extends along a longitudinal axis and comprises first and second bodies assembled together in a first configuration, adjusting the lock from the first configuration to a second configuration by moving the first body with respect to the second body such that the lock is extended in the direction of its longitudinal axis and retracted in a direction transverse to its longitudinal axis, thereby causing the wear member to be locked to the excavating equipment.

According to another embodiment, the present disclosure provides a lock assembly for locking a wear member to excavation equipment, the assembly comprising first and second bodies configured to be assembled together in an assembled condition to form a lock extending along a longitudinal axis, the assembly also comprising an adjustment member operable to move the first body relative to the second body, the first and second bodies defining a cavity in which the adjustment member is received in the assembled condition, the cavity comprising opposing bearing surfaces on which opposing bearing surfaces of the adjustment member bear to enable movement of the first body in opposite directions relative to the second body.

According to another embodiment, the present disclosure provides a wear assembly for attachment to excavation equipment comprising:

a wear member that extends along a longitudinal axis between a forward portion and a rearward mounting portion, the wear member having a recess for receiving a lock; and a lock extending along a longitudinal axis and configured to be inserted into the recess of the wear member to lock the wear member to the excavation equipment, the lock comprising first and second bodies configured to be assembled together in an assembled condition and an adjustment member operable to move the first body relative to the second body, the first and second bodies defining a cavity in which the adjustment member is received in the assembled condition, the cavity comprising opposing bearing surfaces on which opposing bearing surfaces of the adjustment member bear to enable movement of the first body in opposite directions relative to the second body.

BRIEF DESCRIPTION OF THE DRAWINGS

FIG. 7A is an exploded view of the wear assembly and FIG. 7B shows the wear assembly attached to the lip.

In FIG. 8, the lock is shown in a first, expanded, configuration.

DETAILED DESCRIPTION OF THE INVENTION

Figure 2:
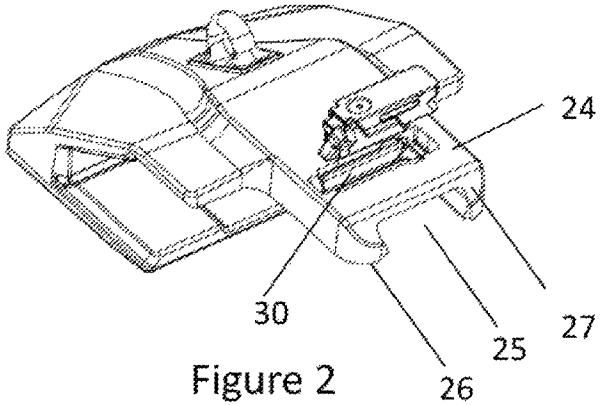
FIG. 2 is a rear exploded view of the wear assembly of FIG. 1.
Figure 3:
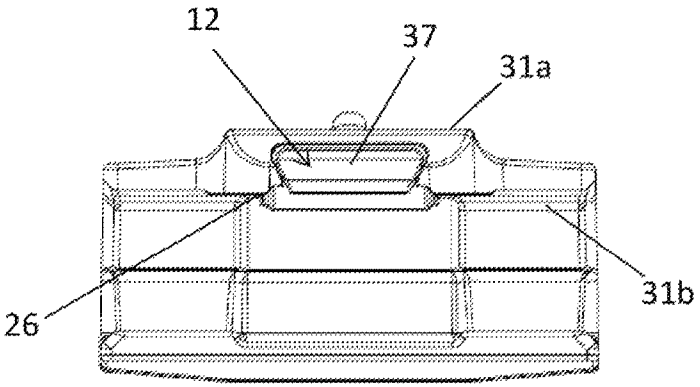
FIG. 3 is a rear view of the wear member and the boss of FIG. 1 in an assembled condition.
Figure 1:
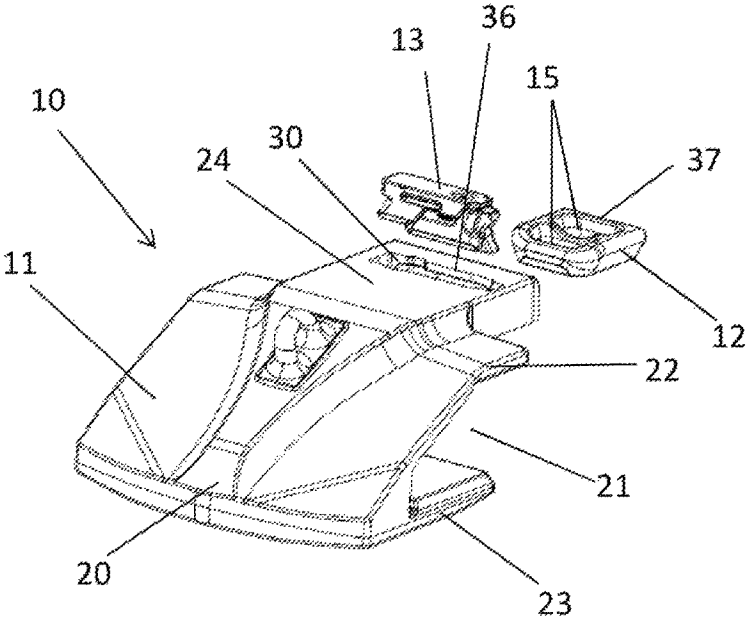
FIG. 1 is a front exploded view of a wear assembly for attachment to excavation equipment according to an embodiment of the present disclosure, the wear assembly comprising a wear member, a boss and a lock according to an embodiment of the present disclosure.
Figure 5:
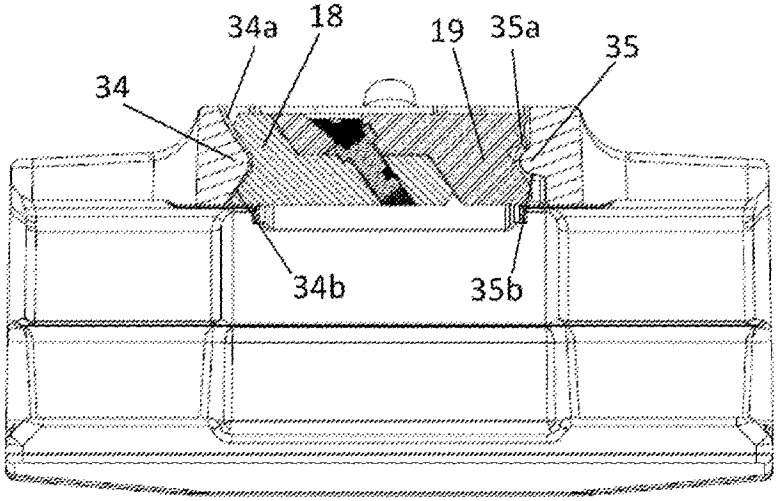
FIG. 5 is a rear view of the wear assembly of FIG. 1 in an assembled condition.
Figure 4:
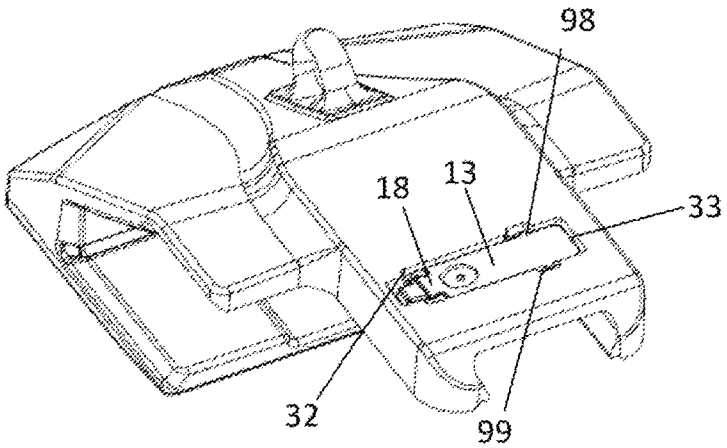
FIG. 4 is a rear perspective view of the wear assembly of FIG. 1 in an assembled condition.

In the following detailed description, reference is made to the accompanying drawings, which form a part thereof In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

Disclosed in some embodiments is a lock assembly for locking a wear member to excavation equipment, the assembly comprising first and second bodies configured to be assembled together, one body substantially positioned over the other, in an assembled condition to form a lock extending along a longitudinal axis, the first and second bodies each comprising at least one interengaging formation, the, or respective ones of the, interengaging formations on the bodies being configured to interengage when the bodies are in the assembled condition to form one or more couplings that resist lateral displacement of the bodies with respect to each other under loads applied transverse to the longitudinal axis of the assembled lock to the side of the first and second bodies.

Lateral displacement of the bodies with respect to each other could include translational movement in a transverse direction to the longitudinal axis of the lock, rotation or twisting of one body with respect to the other about an axis transverse to the longitudinal axis of the lock or a combination of both. Advantageously, because the one or more couplings provide resistance against such lateral displacement under the transverse side loadings, the lock formed from the lock assembly is more stable in use and the bodies of the lock are less likely to twist, slip or buckle under heavy loadings on the wear member. If the bodies of the lock are laterally displaced from their correct alignment with respect to each other, the lock can become jammed in the recess, making removal difficult when the wear member is to be replaced or the lock can break and fall out of the recess resulting in the wear member inadvertently detaching from the excavation equipment.

In an embodiment, each interengaging formation comprises at least one bearing surface, wherein the bearing surfaces of interengaging formations in the or each coupling are configured to bear on one another to provide the resistance to lateral displacement.

In an embodiment, the bearing surfaces extend substantially parallel to the longitudinal axis of the lock.

In an embodiment, the bearing surfaces are disposed to one or both sides of the lock.

In an embodiment, each interengaging formation comprises first and second opposing bearing surfaces, wherein respective ones of the first and second bearing surfaces of interengaging formations in the or each coupling are configured to bear on one another to provide the resistance to lateral displacement.

In an embodiment, each of the first and second bearing surfaces of the first and second bodies extend substantially parallel to the longitudinal axis of the lock. In another embodiment, respective first and second bearing surfaces of each of the first and second bodies are angled toward each other.

Advantageously, the angled bearing surfaces provide the interengaging formations with a 'dovetail' shape which assist in holding the lock bodies together, reducing the risk that the lock can come apart in use or not in use (e.g., when the lock is being transported).

In an embodiment, the first and second bearing surfaces of each interengaging formation are disposed laterally in the lock, to either side of the lock.

In an embodiment, the assembled lock has first and second said couplings located in upper and lower regions of the lock respectively.

In an embodiment, the first and second couplings are located towards opposite longitudinal ends of the lock.

In an embodiment, each coupling is configured to enable the first and second bodies to translate with respect to each other along a translation axis of the lock.

In an embodiment, the translation axis is at an angle to the perpendicular from the longitudinal axis.

In an embodiment, at least one of the couplings formed in the assembled lock is in the form of a tongue and groove connection.

In an embodiment, the bearing surfaces of the interengaging formations comprise the respective side surfaces of the tongue and groove.

In an embodiment, each tongue widens as it extends away from its respective body.

In an embodiment, each groove widens as it extends into its respective body.

In an embodiment, each tongue has an end face and each groove has a corresponding base surface that defines the translation axis of the lock.

In an embodiment, the first and second bodies each comprise an elongate portion that in the assembled condition of the lock extends in the direction of the lock's longitudinal axis, and a foot portion that extends from a first end of the elongate portion, transverse to the longitudinal axis of the lock.

In an embodiment, each of the first and second bodies comprise an interengaging formation on its foot portion and an interengaging formation at its second end of the elongate portion, wherein in the assembled condition, the interengaging formation of respective foot portions on each of the bodies are configured to interengage with the interengaging formation at the second end of the elongate portion of the other body.

In an embodiment, the interengaging formation on the foot portion of each body is a groove and the interengaging formation at the second end of the elongate portion of each body is a tongue.

In an embodiment, in the assembled condition, the elongate portion of the first body is positioned substantially over the top of the elongate portion of the second body.

In an embodiment, the lock also comprises an adjustment member operable to move the first body relative to the second body, the first and second bodies defining a cavity in which the adjustment member is received in the assembled condition.

In an embodiment, the cavity comprises opposing bearing surfaces on which opposing bearing surfaces of the adjustment member bear to enable movement of the first body in opposite directions relative to the second body.

In an embodiment, the adjustment member is operable to be rotated to cause translation of the first body relative to the second body.

In an embodiment, the cavity extends along an axis that is parallel to the translation axis of the lock.

In an embodiment, the cavity comprises a first cavity portion in the first body and a second cavity portion in the second body, the cavity portions axially aligned when the lock is in its assembled condition.

In an embodiment, the adjustment member comprises a threaded shank and a head portion, and wherein in the assembled condition, the head portion is located in the first or second cavity portion and the shank is located in the other of the first or second cavity portions.

In an embodiment, the opposing bearing surfaces of the adjustment member are provided on the head portion.

In an embodiment, the opposing bearing surfaces of the cavity are spaced apart by at least the width of the head portion of the adjustment member.

In an embodiment, the opposing bearing surfaces of the cavity are provided on opposed sides of the cavity.

In an embodiment, one of the opposing bearing surfaces of the cavity comprises an internal surface in one of the first or second bodies.

In an embodiment, the internal surface is defined by a ledge inside the first or second body.

In an embodiment, one of the opposing bearing surfaces of the cavity comprises a portion of an outer surface of one of the first or second bodies.

In an embodiment, the cavity opens through at least one of the bodies to provide tool access to the adjustment member for operation of the adjustment member.

In an embodiment, the lock is adjustable between first and second configurations of the first and second bodies, wherein adjustment of the lock from the first to the second configuration comprises the first body moving with respect to the second body to extend the lock in the direction of the lock's longitudinal axis and retract the lock in a direction transverse to the lock's longitudinal axis.

In an embodiment, a surface indicator is provided on one or both of the first and second bodies for indicating when the lock is in its first configuration.

In an embodiment, the surface indicator comprises a notch.

In an embodiment, the surface indicator is provided on at least one of the interengaging formations.

In an embodiment, in the first configuration the elongate portions of the first and second bodies are spaced from one another and in the second configuration the elongate portions abut one another.

In an embodiment, the lock also comprises a deformable component disposed between the first and second lock bodies, the deformable component adapted to resiliently deform when the lock is adjusted into its second configuration to provide take up for wear of the lock.

In an embodiment, the deformable component comprises a resilient portion and a rigid portion, the resilient portion attached to one of the first or second bodies and the rigid portion attached to the resilient portion and, when the resilient portion is not deformed, the resilient portion projects beyond the body to which the resilient portion is attached.

In an embodiment, one of the first or second bodies has a ramp surface on a side of the body that partly faces the deformable component when the lock is in its first configuration, whereby in the second configuration the deformable component engages the ramp surface and deforms by projecting out to a side of the lock.

In an embodiment, the deformable component extends longitudinally for a substantial portion of the length of the lock.

In an embodiment, each of the lock bodies has a leverage surface for leveraging the lock body independently of the other lock body out of a recess in the wear member, in which the lock is received to lock the wear member to the excavation equipment.

Advantageously, this enables the lock bodies to be easily and individually levered out of the recess even if they have decoupled from each other.

Disclosed in some embodiments is a wear assembly for attachment to excavation equipment comprising:

- a wear member extending along a longitudinal axis between a forward portion and a rearward mounting portion, the wear member having a recess for receiving a lock; and
- a lock that extends along a longitudinal axis and is configured to be inserted into the recess of the wear member to lock the wear member to the excavation equipment, the lock comprising first and second bodies configured to be assembled together, one body substantially positioned over the other, in an assembled condition, the first and second bodies each comprising at least one interengaging formation, the, or respective ones of the, interengaging formations on the bodies being configured to interengage when the bodies are in the assembled condition to form one or more couplings that resist lateral displacement of the bodies with respect to each other under loads applied transverse to the longitudinal axis of the assembled lock to the side of the first and second bodies.

The lock may be formed from a lock assembly as described in any one or more of the above embodiments.

Disclosed in some embodiments is a lock assembly for locking a wear member to excavation equipment, the assembly comprising first and second bodies configured to be assembled together in an assembled condition to form a lock extending along a longitudinal axis, the lock adjustable between first and second configurations of the first and second bodies, wherein adjustment of the lock from the first to the second configuration comprises the first body moving with respect to the second body to extend the lock in the direction of the lock's longitudinal axis and retract the lock in a direction transverse to the lock's longitudinal axis.

In an embodiment, a surface indicator is provided on one or both of the first and second bodies for indicating when the lock is in its first configuration.

In an embodiment, the surface indicator comprises a notch.

This lock assembly may incorporate the features of a lock assembly as described in any one or more of the above embodiments.

Disclosed in some embodiments is a wear assembly for attachment to excavation equipment comprising:

- a wear member that extends along a longitudinal axis between a forward portion and a rearward mounting portion, the wear member having a recess for receiving a lock; and
- a lock extending along a longitudinal axis and configured to be inserted into the recess of the wear member to lock the wear member to the excavation equipment, the lock comprising first and second bodies configured to be assembled together in an assembled condition, the lock adjustable between first and second configurations of the first and second bodies, wherein adjustment of the lock from the first to the second configuration comprises the first body moving with respect to the second body to extend the lock in the direction of the lock's longitudinal axis and retract the lock in a direction transverse to the lock's longitudinal axis, said adjustment of the lock to the second configuration causing the wear member to be locked to the excavation equipment when the lock is located in the recess of the wear member.

In an embodiment, the lock has engaging structures at opposite ends which engage with engaging structures at opposing ends of the recess when the lock is adjusted into its second configuration, the engagement of respective engaging structures holding the lock in the recess.

The lock may be formed from a lock assembly as described in any one or more of the above embodiments.

Disclosed in some embodiments is a method of attaching a wear member to excavating equipment, the method comprising:

mounting a wear member to the excavating equipment, inserting into a recess of the wear member a lock that extends along a longitudinal axis and comprises first and second bodies assembled together in a first configuration, adjusting the lock from the first configuration to a second configuration by moving the first body with respect to the second body such that the lock is extended in the direction of its longitudinal axis and retracted in a direction transverse to its longitudinal axis, thereby causing the wear member to be locked to the excavating equipment.

In an embodiment, adjusting the lock from the first to the second configurations comprises translating the first body with respect to the second body along a translation axis that is transverse to the longitudinal axis of the lock.

Disclosed in some embodiments is a lock assembly for locking a wear member to excavation equipment, the assembly comprising first and second bodies configured to be assembled together in an assembled condition to form a lock extending along a longitudinal axis, the assembly also comprising an adjustment member operable to move the first body relative to the second body, the first and second bodies defining a cavity in which the adjustment member is received in the assembled condition, the cavity comprising opposing bearing surfaces on which opposing bearing surfaces of the adjustment member bear to enable movement of the first body in opposite directions relative to the second body.

This lock assembly may incorporate the features of a lock assembly as described in any one or more of the above embodiments.

Disclosed in some embodiments is a wear assembly for attachment to excavation equipment comprising:

a wear member that extends along a longitudinal axis between a forward portion and a rearward mounting portion, the wear member having a recess for receiving a lock; and a lock extending along a longitudinal axis and configured to be inserted into the recess of the wear member to lock the wear member to the excavation equipment, the lock comprising first and second bodies configured to be assembled together in an assembled condition and an adjustment member operable to move the first body relative to the second body, the first and second bodies defining a cavity in which the adjustment member is received in the assembled condition, the cavity comprising opposing bearing surfaces on which opposing bearing surfaces of the adjustment member bear to enable movement of the first body in opposite directions relative to the second body.

The lock may be formed from a lock assembly as described in any one or more of the above embodiments.

In some embodiments, the wear assembly also comprises a boss attachable to the excavation equipment, wherein the rearward mounting portion of the wear member mounts to the boss in an assembled condition.

Referring now to FIGS. 1-5, there is illustrated a wear assembly 10 for mounting to excavation equipment comprising a wear member in the form of a shroud 11, a boss 12 and a lock 13. The wear assembly comprising the shroud is for protecting the digging edge of, for example, a bucket lip from wear. The shroud 11 may be positioned between excavation teeth that have been provided on the bucket lip, or where excavation teeth are not present, multiple shrouds may be positioned along the length of the bucket lip.

Figure 6:
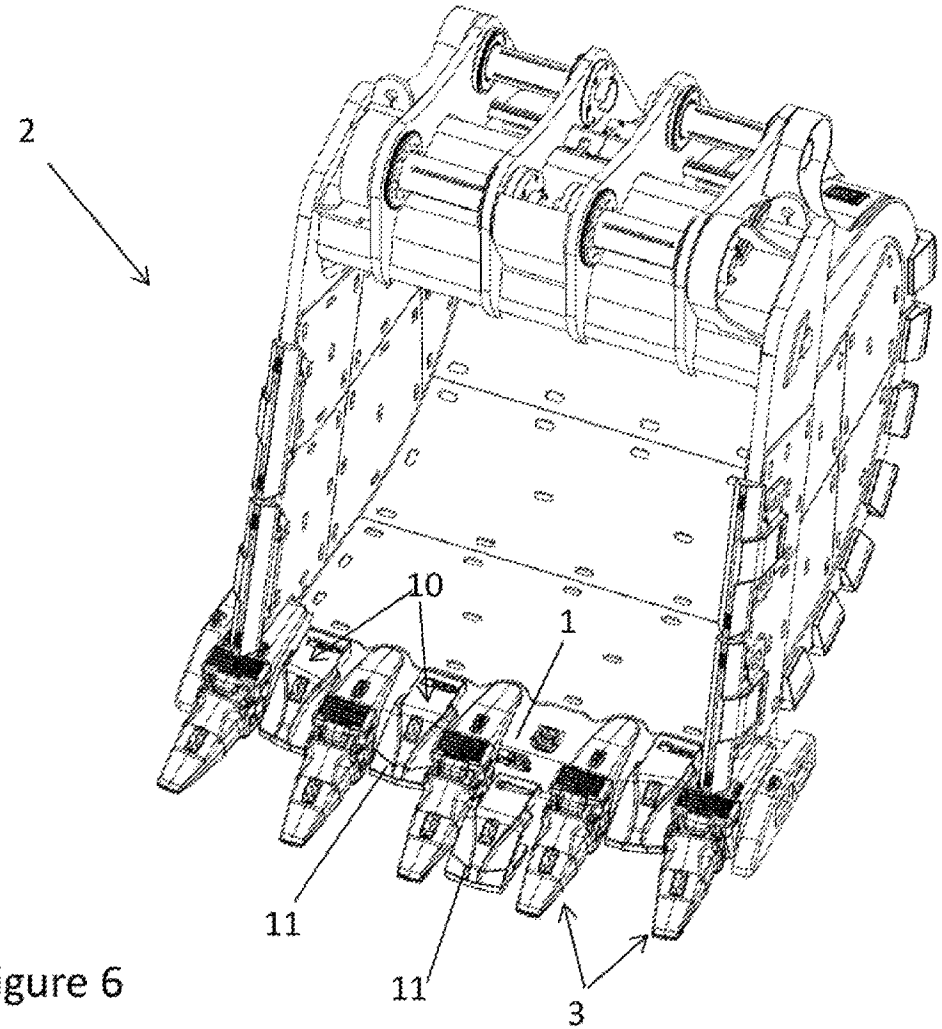
FIG. 6 is a perspective view of an excavation bucket having a plurality of the wear assemblies of FIG. 1 attached to its lip.
Figure 7B:
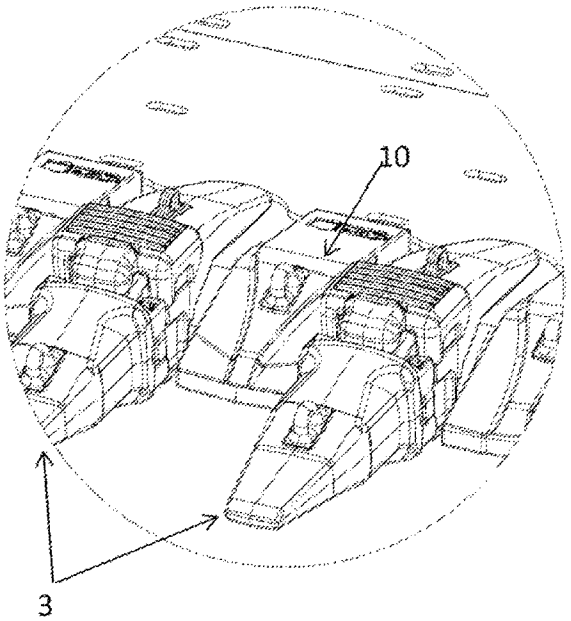
FIGS. 7A and 7B are close up views of one of the wear assemblies shown in FIG. 6 in relation to the lip of the excavation bucket.
Figure 7A:
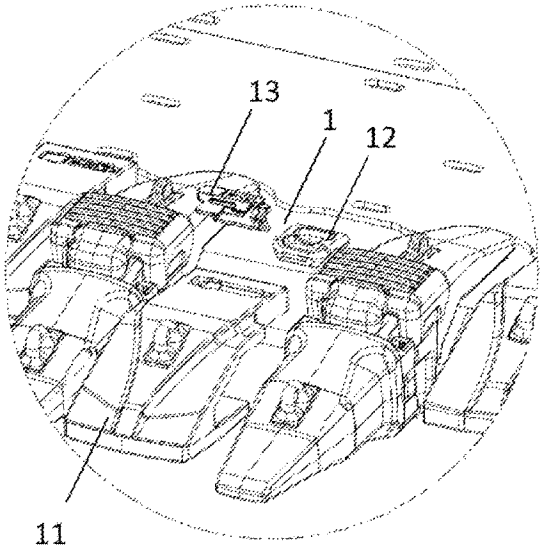
Figure 9:
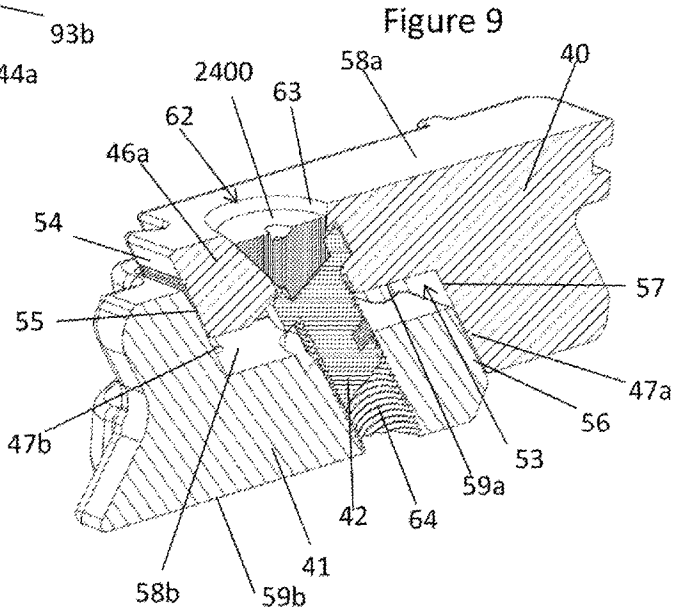
FIG. 9 is a sectional view of the lock of FIG. 8.
Figure 8:
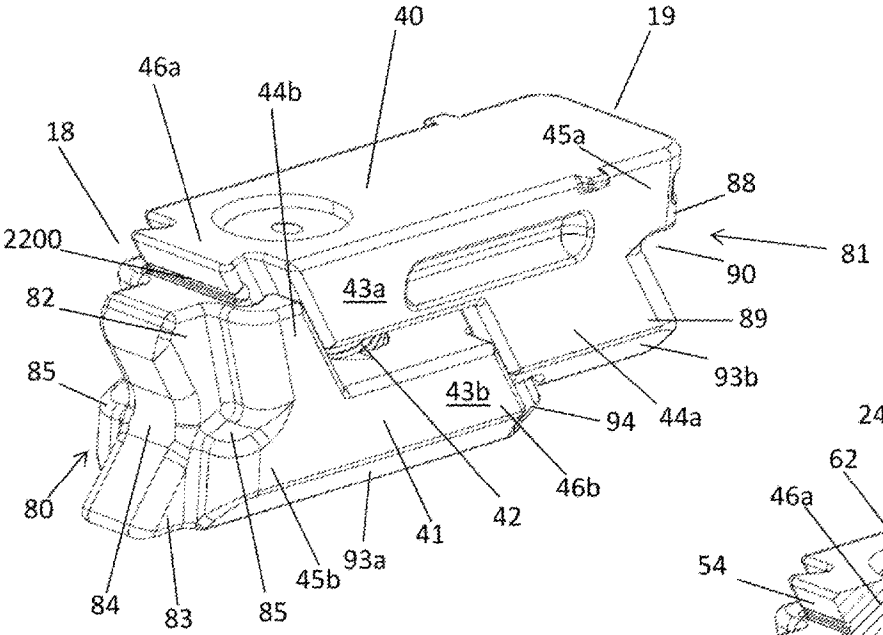
FIG. 8 is a perspective view of the lock of FIG. 1 for locking the wear member to excavation equipment, the lock comprising a lock assembly of first and second bodies.
Figures 10A, 10B, 10C:
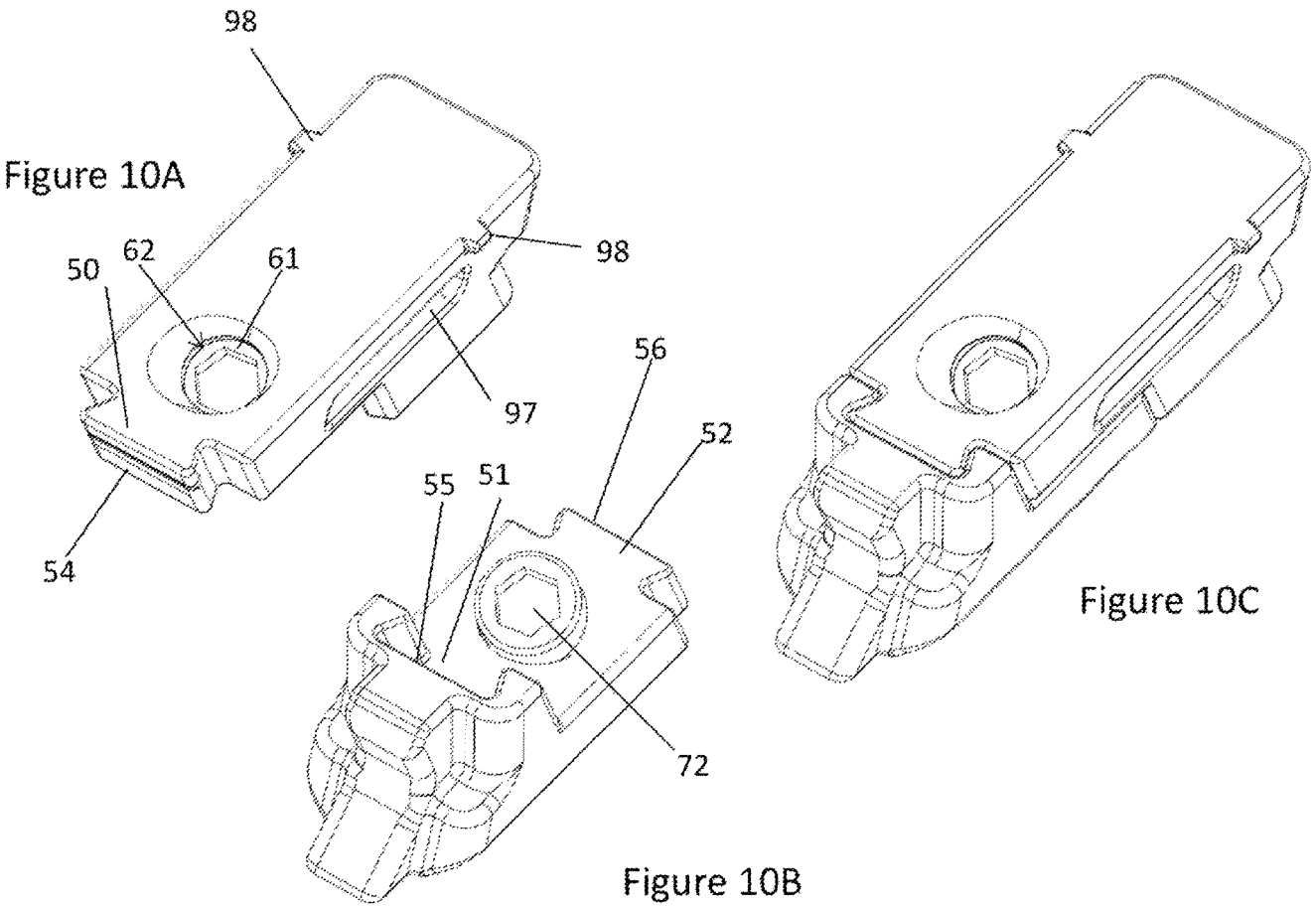
FIG. 10A is a top perspective view of the lock of FIG. 8 without the second body.
FIG. 10B is a top perspective view of the lock of FIG. 8 without the first body.
FIG. 10C is a top perspective view of the lock of FIG. 8 with the lock in a second, collapsed, configuration.
Figure 11B:
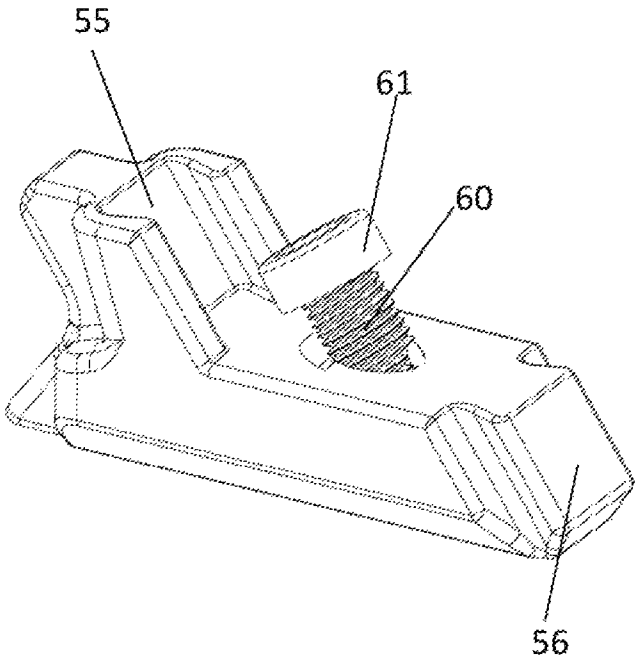
FIGS. 11A and 11B are perspective views of the second body of the lock assembly of FIG. 8 without and with an adjustment member of the lock assembly shown relative to the second body.
Figure 11A:
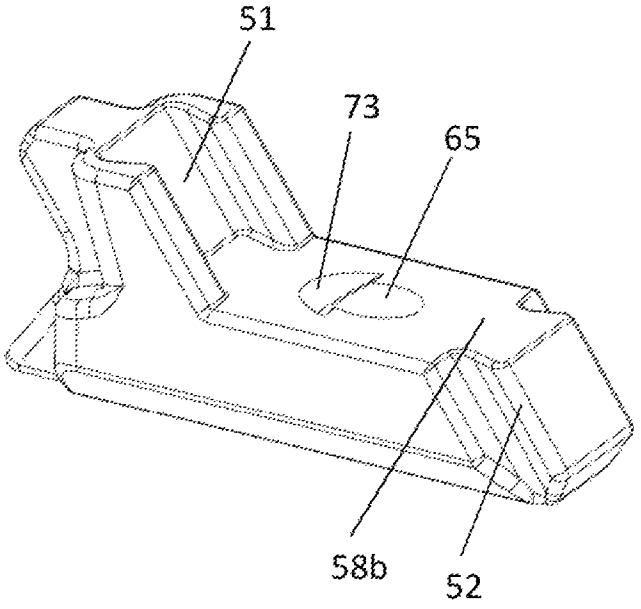
Figure 12A:
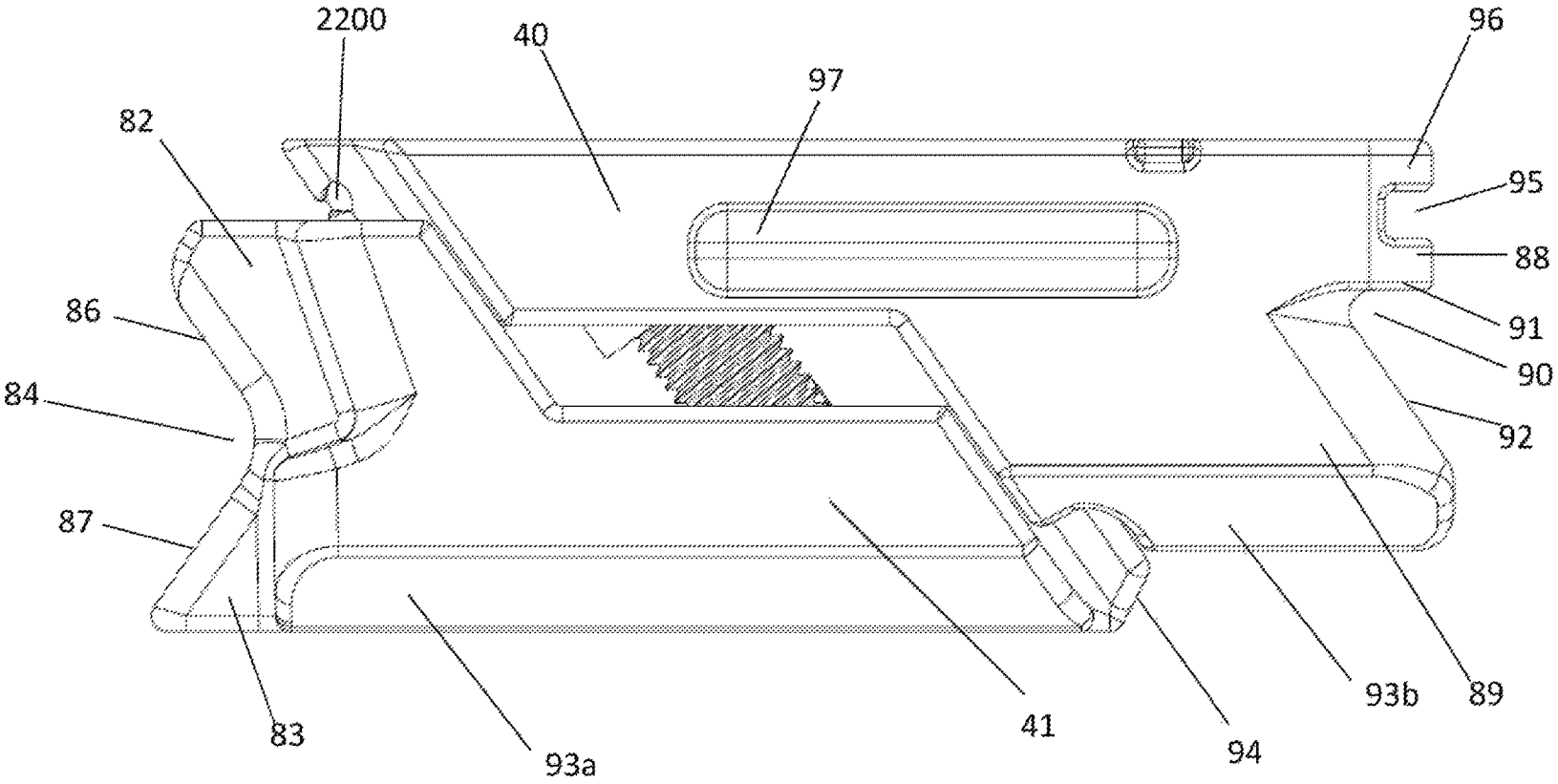
FIG. 12A is a side view of the lock of FIG. 8 in its first, expanded, configuration.
Figure 12B:
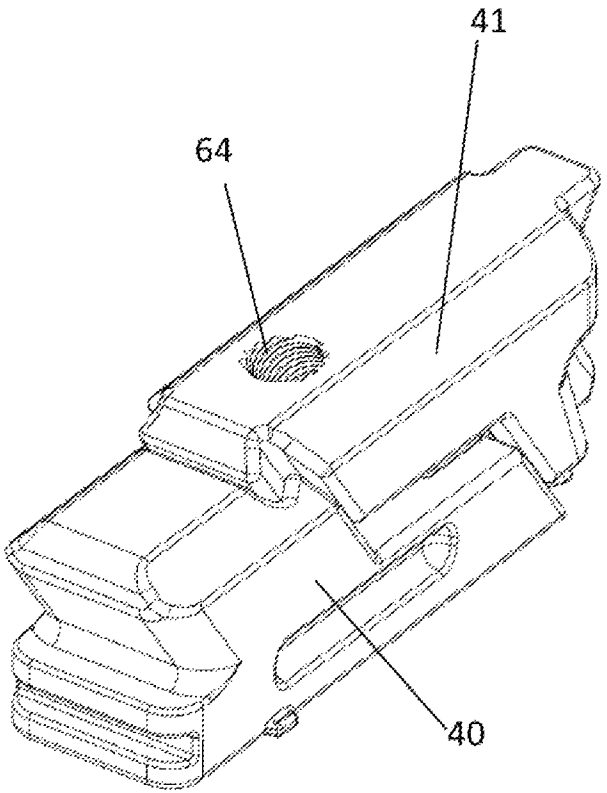
FIG. 12B is a bottom perspective view of the lock of FIG. 8 in its first, expanded, configuration.

FIGS. 6, 7A and 7B show the mounting of a plurality of the wear assemblies 10 to a lip 1 of an excavation bucket 2. The shroud 11 of each assembly is positioned between adjacent excavation teeth 3 that are also mounted to the bucket lip 1.

The shroud 11 has a longitudinal axis extending through a front ground engaging portion 20 comprising upper and lower converging surfaces and a rear mounting portion 21 for mounting the shroud to the bucket lip over the digging edge in an assembled condition. The mounting portion 21 comprises spaced apart upper and lower legs 22, 23. Inner surfaces of the legs are configured to engage respective upper and lower surfaces of the lip 1 when the shroud 11 is mounted thereto (as shown in FIGS. 6, 7A and 7B). The upper leg 22 has a holding section 24 that projects rearwardly beyond the lower leg 23. The holding section 24 has a cavity 25 extending in the longitudinal direction of the shroud 11. The cavity 25 opens to the inner surface 26 and rear end 27 of the upper leg 22 The cavity 25 is configured to receive the boss 12 when the boss is mounted to the upper surface of the lip, such that the holding section 24 can slide over the boss as the shroud 11 is mounted to the lip. When the assembly 10 is in its assembled condition, the boss 12 remains captured within the cavity 25 of the shroud 11 such that the boss limits the shroud 11 from moving upwardly away from the lip (i.e., in the perpendicular direction from the upper surface of the lip). The boss 12 is provided with recesses 15 that define weld locations for welding the boss to the lip 1.

The shroud 11 also comprises a recess 30 (preferably located in the holding section 24 of the upper leg 22) for receiving the lock 13 to hold the shroud 11 to the lip of the excavation equipment. The recess 30 opens to the upper and lower surfaces 31*a, b* of the upper leg 22, extending through the cavity 25 that is formed in the upper leg 22. The recess 30 extends laterally with respect to the longitudinal axis of the shroud 11 between first and second ends 32, 33. At each end of the recess, there is provided engaging structures 34, 35 for the lock 13 to engage to retain the lock in the recess. Each of the engaging structures 34, 35 comprise shoulder formations that define upper and lower surface portions 34*a,b* and 35*a,b* respectively. The upper surface portions 34*a,* 35*a* face at least partly upward towards the recess opening through the upper surface of 31*a* of the upper leg 22. The lower surface portions 34*b,* 35*b* face at least partly downward towards the recess opening through the lower surface of 31*b* of the upper leg 22. The interaction of the lock 13 with these engagement structures 34, 35 will be described in further detail below. When the lock 13 is located in the recess 30, it is positioned between a side wall 36 of the recess and the rear end 37 of the boss 12. This limits the shroud 11 from moving in a forward direction, and thus prevents the shroud from disengaging from the boss 12 and detaching from the excavation equipment.

The lock 13 according to the embodiment illustrated in the wear assembly 10 in FIGS. 1-5 is shown and described in relation to FIGS. 8-15B below.

The lock 13 is elongate, extending along a longitudinal axis between first and second ends 18, 19. The lock 13 is formed from a lock assembly comprising first and second lock bodies 40, 41 and an adjustment member 42 operable to move the first and second bodies relative to each other.

Each of the bodies 40, 41 are generally L-shaped with an elongate portion 43*a,b* and a foot portion 44*a,b* extending transversely from the elongate portion. The foot portion 44*a,b* is located towards a first end 45*a,b* of the elongate portion 43*a,b*. The bodies 40, 41 are configured so that when they are in an assembled condition, their respective elongate portions are parallel to each other and their respective second ends 46*a,b* engage an inner surface 47*a,b* of the foot portion 44*a,b* of the other body. Thus, in the assembled condition, the bodies 40, 41 are vertically stacked with the elongate portion 43*a* of the first body 40 positioned above the elongate portion 43*b* of the second body 41. The parallel elongate portions 43*a,b* in the assembled condition define the longitudinal axis of the lock 13. In the assembled condition, the first end 45*b* of the second body 41 is located at the first end 18 of the lock 13 and the first end 45*a* of the first body 40 is located at the second end 19 of the lock.

The bodies 40, 41 comprise first and second respective interengaging formations that interengage when the bodies are in the assembled condition to form first and second respective couplings. The interengaging formations are in the form of tongue and groove formations. The first of the couplings comprises a tongue 50 at the second end 46*a* of the first body 40 that is configured to be received in a groove 51 formed in the inner surface 47*b* of the foot portion 44*b* of the second body 41. The second of the couplings comprises a tongue 52 at the second end 46*b* of the second body 41 and a groove 53 in the inner surface 47*a* of the foot portion 44*a* of the first body 40. The first and second couplings are arranged such that there is a coupling at each end of the lock and in upper and lower regions of the lock. The first and second couplings are spaced from each other by the elongate portions 43*a,b* of the bodies 40, 41.

The end face 54 of the tongue 50 on the first body 40 defines a surface that is parallel to the base surface 57 of the groove 53 of the first body 40, both of which are at a transverse angle (but not perpendicular) to the lock's longitudinal axis. Similarly, the end face 56 of the tongue 52 on the second body 41 defines a surface that is parallel to the base surface 55 of the groove 51 of the second body 41 both of which are also at the same transverse angle to the lock's longitudinal axis. This allows for the first body to slide over the second body easily along a translation axis defined by the surfaces 54-57, which is transverse to but not perpendicular to the lock's longitudinal axis, as discussed further below.

Each of the tongues 50, 52 widen as they extend away from their respective first and second bodies 40, 41. This means that the side surfaces of the respective tongues 50, 52 are angled toward each other in the direction toward their respective bodies 40, 41. Similarly, the grooves 51, 53 widen as they extend into their respective first and second bodies 40, 41 so as to accommodate the tongue of the other body. The side surfaces of the grooves are thus angled away from each other as they extend into their respective bodies. The tongues and grooves 50-53 thus have a dovetail profile.

When the lock 13 is located in the recess 30 of the shroud 11, the lock is positioned such that its longitudinal axis is perpendicular to the longitudinal axis of the shroud. In use, because the lock is positioned to limit movement of the shroud 11 in the direction of the shroud's longitudinal axis, loads are applied on the lock transverse to the lock's longitudinal axis to the side of the lock. Because the lock 13 comprises first and second bodies 40, 41 that are assembled together in a vertical arrangement whereby the first body is positioned above the second body, the side transverse loads on the lock can result in lateral displacement of the lock bodies with respect to the other. The first and second tongue and groove couplings described above resist this lateral displacement of the bodies with respect to each other because the tongues 50, 52 bear against respective side surfaces of the grooves 51, 53 in which they are received. Lateral displacement is resisted by the tongue and groove arrangements because the lock bodies 40, 41 have surfaces which bear on each other that are laterally disposed on either side of the lock. Further, the tapered shape of the tongues and grooves 50-53 provide resistance to longitudinal displacement and reduce the risk of the lock 13 pulling apart under longitudinal forces.

It is to be understood that the bodies could incorporate couplings having other tongue and groove arrangements, for example the first body could have tongues which are received in the grooves on the second body or the bodies may have multiple ridges, instead of single tongues, which are received in an equal number of channels. Furthermore, other interengaging formations could be provided on the first and second bodies of the lock to form couplings that provide resistance to lateral displacement of the bodies with respect to each other and which have mating surfaces between the bodies that are disposed transversely to the longitudinal axis of the lock.

The interengaging formations are arranged, however, to enable the first and second bodies to move by translation along the translation axis defined by the tongue end faces 54, 56 which mate with respective groove base surfaces 55, 57. That is, the tongues 50, 52 are capable of sliding within the grooves 51, 53. The adjustment member 42 is provided to operate this movement.

The adjustment member 42 comprises a threaded shank 60 extending from a head portion 61 and in the embodiment shown in FIGS. 8-15B is in the form of a cap screw. The lock bodies 40, 41 define a cavity 62 in which the adjustment member 42 is received. The cavity 62 extends across the bodies 40, 41 and comprises a first cavity portion 63 in the elongate portion 43*a* of the first body 40 and a second cavity portion 64 in the elongate portion 43*b* of the second body 41. Each cavity portion 63, 64 opens through the top and bottom surfaces 58*a,b* and 59*a,b* of the long portions 43*a,b* of their respective bodies 40, 41. The cavity portions 63, 64 are axially aligned when the bodies 40, 41 are in the assembled condition. The cavity 62 extends through the bodies 40, 41 transverse to the longitudinal axis of the lock 13 and substantially parallel to the tongue end faces 54, 56 and the groove base surfaces 55, 57.

The internal surface 65 of the second cavity portion 64 is threaded for threaded engagement by the shank 60 of the adjustment member 42. No thread is provided on the internal surface of the first cavity portion 63.

The threaded shank 60 of the adjustment member has an aperture 2300 towards the distal end of the shank from the head portion 61. The aperture 2300 is for receiving a friction plug 2301, such as a nylon plug, for frictional engagement with the threaded surface 65 of the second cavity portion 64. The friction plug 2301 reduces the risk that the adjustment member 42 could work itself loose during use of the wear assembly 10.

The cavity 62 includes opposing bearing surfaces 66, 67, transverse to the axis of the cavity 62, which provide surfaces on which opposing bearing surfaces 68, 69 of the adjustment member 42, defined on its head portion 61, bear respectively. The bearing of adjustment member 42 through surfaces 68, 69 on respective surfaces 66, 67 of the cavity enable the adjustment member 42 to move the first body 40 with respect to the second body 41 by transmitting a force through the bearing surfaces when the adjustment member 42 is rotated. Depending on the direction of rotation, the adjustment member 42 will cause the first body 40 to move toward or away from second body 41 in the direction of the axis of the cavity 62 (corresponding to the translation axis) by the bearing engagement of the upper surfaces 66, 68 or the lower surfaces 67, 69.

The cavity bearing surfaces 66, 67 are, in the embodiment shown in the Figures, defined by the first cavity portion 63 in the first body 40. However, in other embodiments, the cavity bearing surfaces could be defined in the second cavity portion 64 in the second body 41 or one surface may be defined in the first cavity portion and one in the second cavity portion or they may in part be defined in both the first and second cavity portions.

The upper bearing surface 66 of the cavity 62 is defined by a tapered depression 70 in the lower surface 59*a* of the first body's elongate portion 43*a*. The surface of the tapered depression is at an angle to the lower surface 59*a* and is also perpendicular to the axis of the cavity 62. The lower bearing surface 67 of the cavity 62 is located internally in the first body 40 and is defined by a ledge 71 that is formed in the cavity 62 on the opposite side of the cavity to the tapered depression 70. In the embodiment shown in the Figures, the cavity bearing surfaces 66, 67 are spaced apart in the direction of the cavity's axis by a distance corresponding to at least the width of the head portion 61 of the adjustment member 42 so that the head portion is retained therebetween. In some embodiments, the bearing surfaces 66, 67 are spaced apart by a distance slightly greater than the width of the head portion 61 to provide manufacturing tolerance.

The head portion 61 of the adjustment member 42 has a tool engagement portion 72 on its upper surface for engagement by a tool, through the opening of the first cavity portion 63 in the upper surface 58*a* of the first body 40, to rotate the adjustment member. The tool engagement portion 72 is in the form of a hexagonal recess, but could be a hexagonal projection or any other suitable recess, projection or other formation that can be engaged by a suitable tool for rotating the adjustment member.

The lock 13 is also provided with a plug 2400 that is inserted into the cavity 62 above the head portion 61 of the adjustment member 42. The plug 2400 is formed of an elastomeric material and is shaped to provide a seal against the ingress of fines into the cavity 62, in particular into the first cavity portion 63, during use of the wear assembly 10. This is to ensure that the tool engagement portion 72 of the adjustment member 42 can be readily accessed and engaged when removing the lock 13 from the shroud recess 30. The plug 2400 is removed from the cavity 62 to provide access to the adjustment member 42 by prying the plug 2400 out of the cavity using a suitable tool such as a screw driver.

The first cavity portion 63 above the location of the head portion 61 of the adjustment member 42 is provided with an outward taper towards the upper surface 58*a* of the first body 40. This is to ease the insertion and removal of the plug 2400 and to ease the removal of any fines that have accumulated in the first cavity portion 63 during use.

Figure 13B:
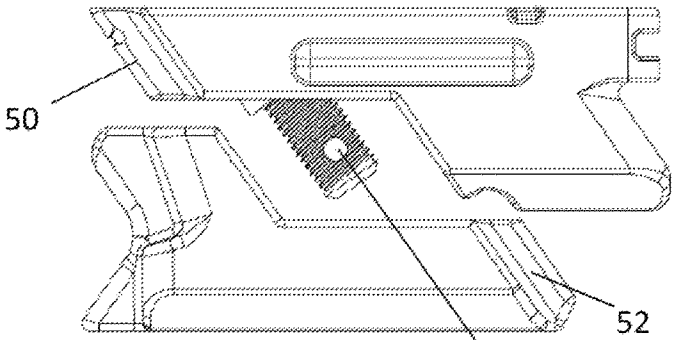
FIGS. 13A to 13C illustrate the sequence of steps for assembling the lock assembly of FIG. 8 to form the lock.
Figure 13A:
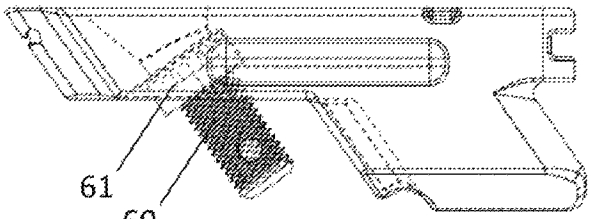
Figure 13C:
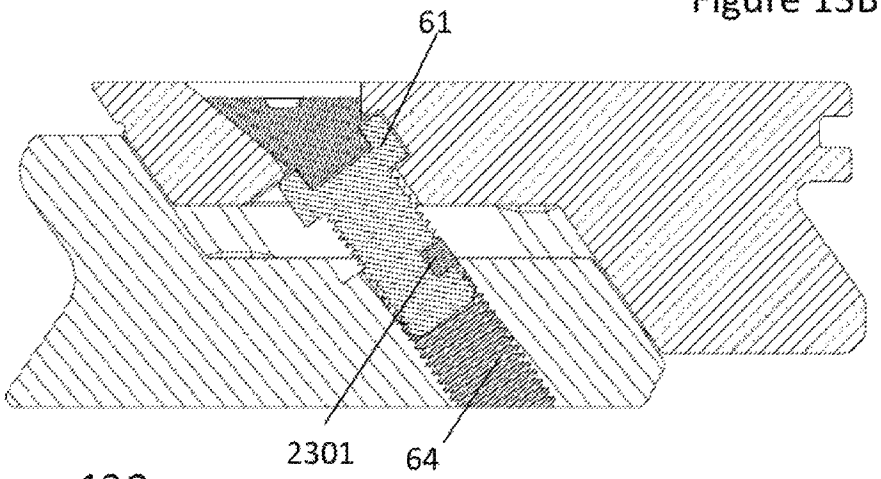

Referring to FIGS. 13A-13C, assembly of the bodies 40, 41 and the adjustment member 42 into the assembled condition is shown. The first step (as shown in FIG. 13A) of assembling the lock 13 involves sliding the adjustment member 42 into engagement with the first body 40 such that the head portion 61 of the adjustment member 42 is received between the bearing surfaces 66, 67 of the cavity 62 that are formed in the first body 40. With the adjustment member 42 so received in the first body 40, the first body 40 is aligned with the second body 41 as shown in FIG. 13B. The tongues and grooves 50-53 of the bodies 40, 41 are then brought into sliding engagement and the bodies 40, 41 slide across each other along the translation axis until the threaded shank 60 of the adjustment member 42 begins to be received into the threaded second cavity portion 64 in the second body, as shown in FIG. 13C. The adjustment member 42 can then be rotated using an appropriate tool to cause the continued movement of the first body 40 with respect to the second body 41 along the translation axis.

Figure 14A:
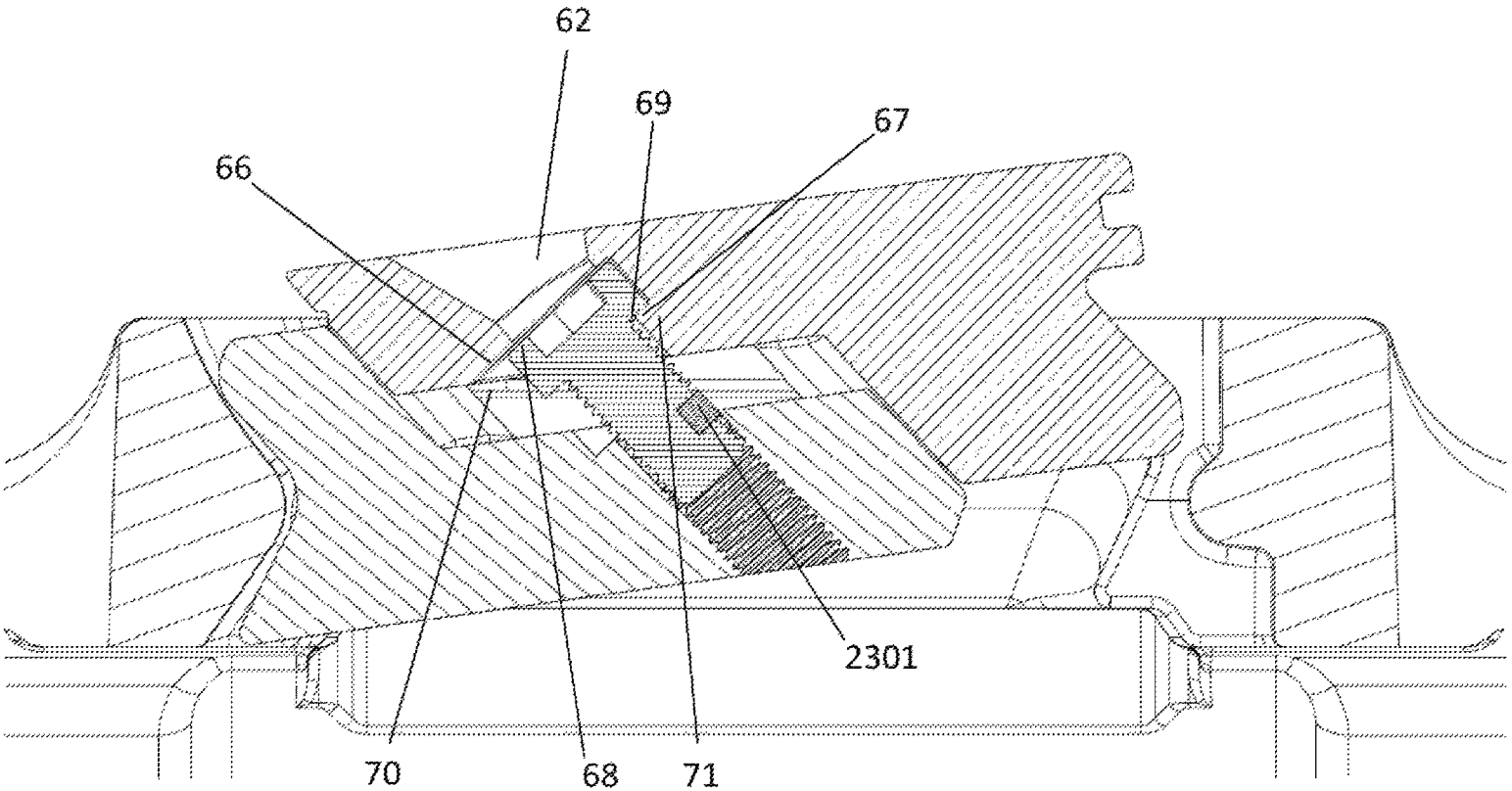
FIGS. 14A to 14D illustrate the sequence of steps for using the lock to lock the wear member of FIG. 1 to the excavation equipment.
Figure 14B:
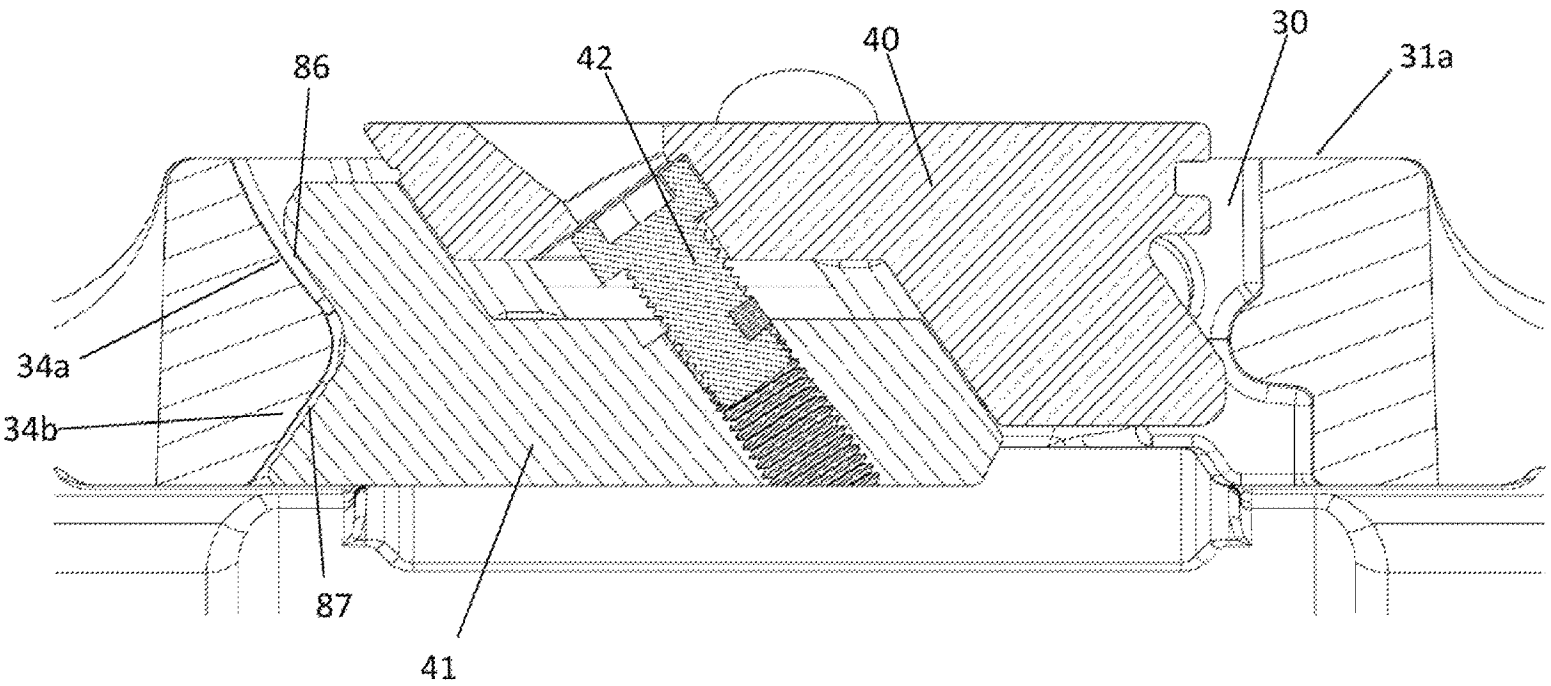
Figure 14C:
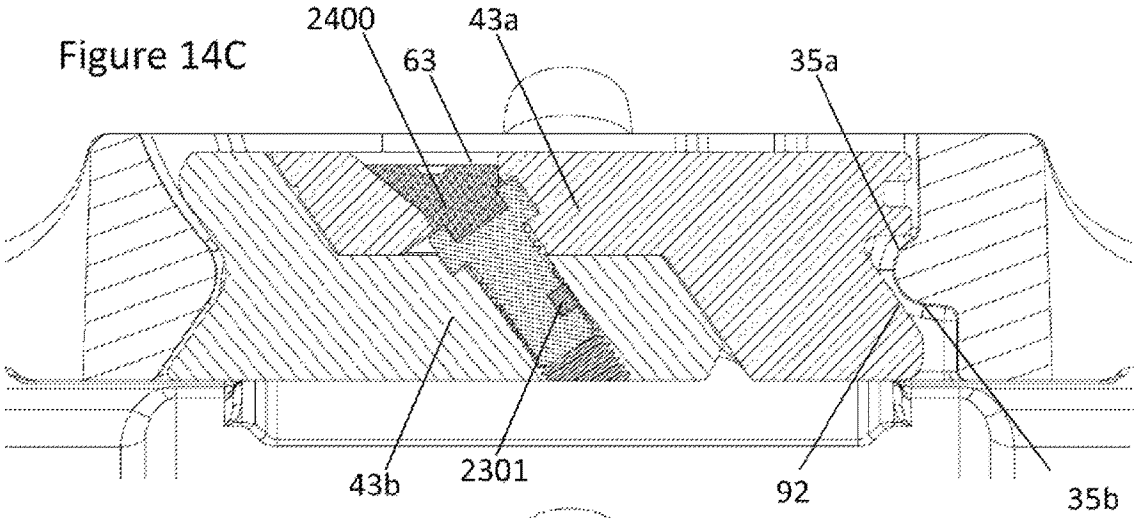
Figure 14D:
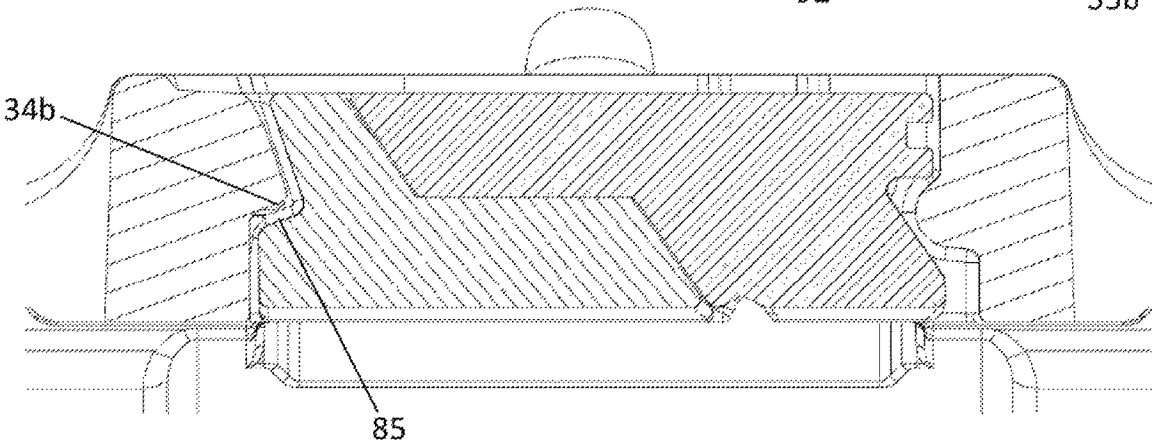

Once the lock 13 is in its assembled condition, the adjustment member 42 is operable to move the first body 40 with respect to the second body 41 to adjust the lock 13 between a first configuration as shown in FIG. 14B and a second configuration as shown in FIG. 14C. In the first configuration, the elongate portions 43*a,b* of the bodies 40, 41 are spaced from each other such that the lock 13 can be considered to be in an expanded configuration. To cause the lock 13 to adopt the second configuration, the adjustment member 42 is rotated, causing the threaded shank 60 of the member to move further into the second cavity portion 64 in the second body 41. The head portion 61 of the adjustment member 42 bearing on the lower bearing surface 67 of the cavity 62 thus causes the first body 40 to translate relative to the second body 41 in the same direction as the adjustment member 42 is translating relative to the second body 41. During this movement, the tongue 50 of the first body 40 slides along the groove 51 of the second body 41 and the groove 53 of the first body slides over the tongue 52 of the second body. This helps guide the translation of the first body with respect to the second body and limits any rotation of the bodies 40, 41 as a result of rotating the adjustment member 42.

The head portion 61 of the adjustment member 42 projects beyond the lower surface 59*a* of the first body's elongate portion 43*a*. The upper surface 58*b* of the second body's elongate portion 43*b* has an indentation 73 which receives this projection of the head portion when the lock 13 is in the second configuration. This provides clearance for the head portion 61 in the second body when the lock is in its second configuration.

In the second configuration, the lock 13 is in a vertically collapsed configuration from the expanded first configuration, the lock having been retracted in a direction transverse to the longitudinal axis of the lock. However, because the translation axis is not perpendicular to the lock's longitudinal axis, adjustment of the lock from the first configuration to the second configuration extends the lock in the direction of its longitudinal axis. This involves the first body 40 being moved in part in the longitudinal direction with respect to the second body 41. The lock can be adjusted from the second configuration to the first configuration, by the reverse of this process. The first and second configurations are used for inserting and then locking the lock 13 in the recess 30 in the shroud 11 as will be described in further detail below.

An advantage of the dovetail shaping of the tongues and grooves 50-53 is that while it enables the tongues and grooves to be brought into engagement and move in the direction of the translation axis, they limit longitudinal as well as lateral movement of the bodies 40, 41 with respect to each other. As a result, the bodies 40, 41 are less likely to disassemble from each other, even when the lock 13 is in its fully expanded first configuration, enhancing reliability, safety and ease of transport and installation of the lock 13.

An additional feature of the lock 13 is a surface indicator in the form of a notch 2200 for indicating when the lock 13 is in its first configuration and is capable of being inserted and removed from the recess 30 in the shroud 11. The notch 2200 is provided along the end face 54 of the tongue 50 on the first body 40. In this location, the notch 2200 is in an upper region of the lock where it will be visible when the lock is located in the recess 30 and in its first configuration. However, the notch could be provided in other regions of the lock 13.

At each end 18, 19 of the lock there is provided an engaging structure 80, 81 for respectively engaging the engaging structures 34, 35 at respective ends 32, 33 of the recess 30 in the shroud 11 to hold the lock in the recess. The first engaging structure 80 is provided at the first end 45*b* of the second body 41. The first engaging structure 80 comprises projections 82, 83 extending from the first end 45*b* of the body 41, the projections 82, 83 defining a recess 84 therebetween at the first end 18 of the lock. The first engaging structure 80 also comprises shoulder portions 85 formed in the first end 45*b* of the second body 41 to either side of the projections 82, 83. The recess 84 and the shoulder portions 85 provide upper and lower engaging surface portions 86, 87 for engaging respective upper and lower surface portions 34*a,b* of the first engaging structure 34 in the shroud recess 30.

The second engaging structure 81 is provided at the first end 45*a* of the first body 40. The second engaging structure comprises projections 88, 89 extending from the first end 45*a* of the first body 40, the projections 88, 89 defining a recess 90 therebetween at the second end 19 of the lock. The recess 90 provides upper and lower engaging surface portions 91, 92 for engaging upper and lower surface portions 35*a,b* of the second engaging structure 35 in the shroud recess 30.

Referring to FIGS. 14A-D, insertion and locking of the lock 13 into the recess 30 of the shroud 11 is shown. To initiate insertion, the lock 13, in its assembled condition, is placed in its first configuration in which it is retracted longitudinally but expanded transverse to its longitudinal axis. The first engaging structure 80 of the lock is brought into initial engagement to the first engaging structure 34 in the recess by sliding the lock into the recess at a slight angle to the recess as shown in FIG. 14A. The lock 13 is then rotated about its first end 18 in order to drop the second end 19 of the lock into the recess 30 and enable the lock to sit on the underlying lip of the excavation equipment. In this position, the lock sits loosely in the recess 30 and without the second engaging structure 81 of the lock engaging the second engaging structure 35 of the recess. The lock 13 is provided with clearance portions in the form of chamfered bottom corners 93*a* on the elongate portion 43*b* of the second body 41 and chamfered end corners 93*b* on the foot portion 44*a* of the first body 40. The chamfered corners 93*a,b* are aligned when the lock is in its second configuration and provide clearance for the lock from welds if they have been used to weld other components to the lip such as the boss 12, when the lock is placed in the recess 30. This clearance reduces the risk that the lock will have poor fitment within the recess.

To complete the insertion of the lock 13 into the recess 30, the adjustment member 42 is operated to adjust the lock from its first configuration to its second configuration, as described above. This causes the first body 40 of the lock to be fully retracted into the recess 30 with its top surface 58*a* is below the upper surface 31 of the shroud 11. It also causes the lock 13 to extend in the direction of its longitudinal axis. This brings the second engaging structure 81 of the lock into engagement with the second engaging structure 35 in the recess and forces the first engaging structure 80 of the lock into tighter engagement with the first engaging structure 34 in the recess. In this configuration within the recess 30, the lock 13 is securely held in the recess 30. More specifically, the lock is held by the engagement of the projection 83 and the shoulder portions 85 of the first engaging structure 80 of the lock with the lower surface portion 34*b* of the first engaging structure 34 of the recess and the engagement of the projection 89 of the second engaging structure 81 of the lock with the lower surface portion 35*b* of the second engaging structure 35 of the recess. As a final step, the plug 2400 is inserted into the upper cavity portion 63 (FIG. 14C).

The cavities 84 and 90 of respective engaging structures 80, 81 enable the lock 13 to move with the shroud 11 when the lock 13 is held in the recess 30. This is because once the lock 13 is brought into it's second configuration, it is effectively integrated with the shroud 11. As a result, the risk of the lock 13 being ejected from the recess 30 during use and the shroud 11 detaching from the excavation equipment is reduced.

Figure 15A:
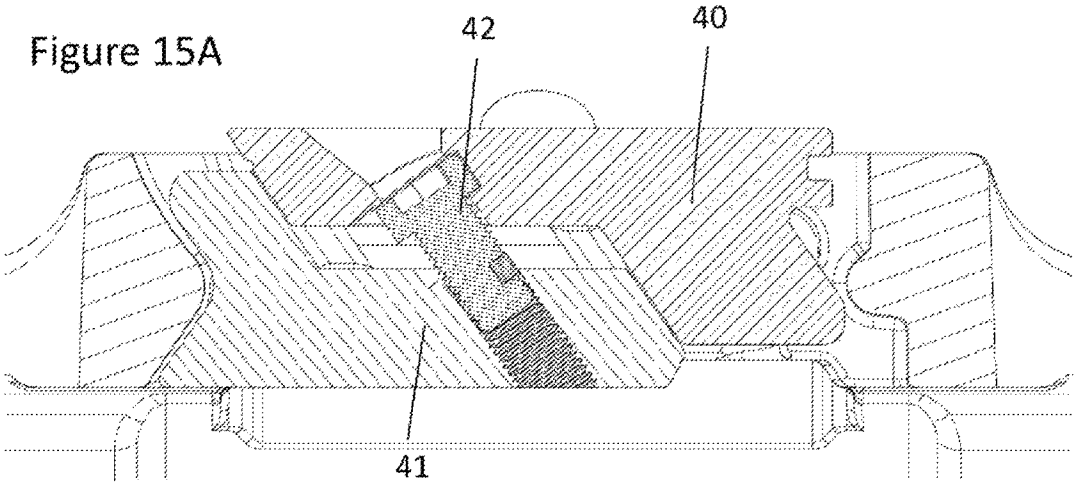
FIGS. 15A and 15B illustrate the sequence of steps for removing the lock to enable detachment of the wear member from the excavation equipment.
Figure 15B:
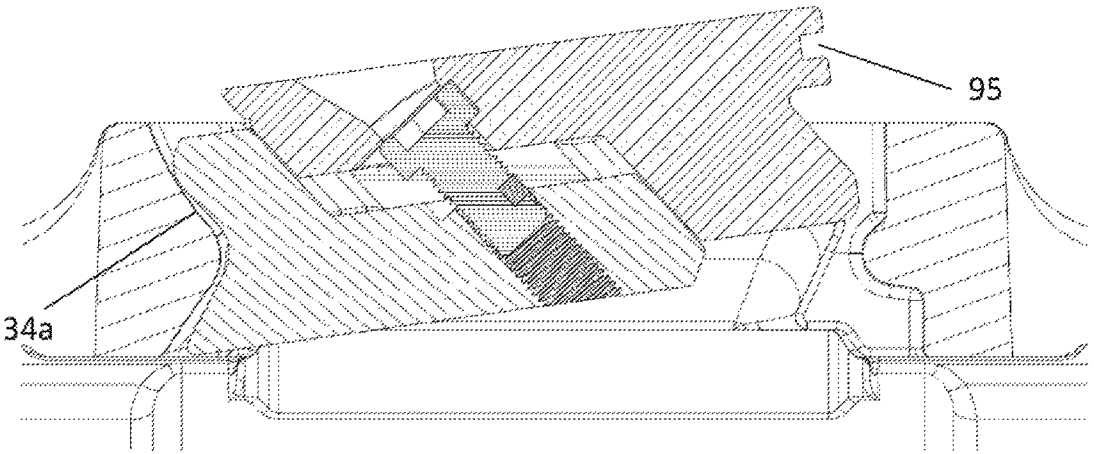

As illustrated in FIGS. 15A and 15B, to remove the lock 13 from the recess 30, the lock is first adjusted back from its second configuration to its first configuration (after removing the plug 2400). The lock 13 is then pried out of the recess using an appropriate tool which engages a pry slot 95 that is formed at the second end 19 of the lock 13 between one of the second engaging structure projections 88 and a further, parallel, projection 96 that projects from the first end 45*a* of the first body 40. During this prying of the lock 13 out of the recess 30, the lock pivots on the upper surface portion 34*a* of the first engaging structure 34 of the recess 30. The upper surface portion 34*a* has an angled face, which eases this pivoting of the lock and enables the removal of the lock from the recess quickly and with minimal effort. Finger slots 97 are provided on each side of the lock 13 for a user to grip once the lock has been sufficiently pried out of the recess 30.

A levering chamfer 94 is provided on the bottom end of the tongue 52 of second body 41. This chamfer 94 is used to lever the second body 41 out of the recess, if necessary, independently of the first body 40. In the normal process of removing the lock from the recess, the second body 41 would remain attached to the first body 40 and would therefore be removed from the recess under the action on the pry slot 95 of the first body. However, should the second body 41 decouple from the first body 40, either as a result of completely removing the adjustment member 42 or as a result of one of the lock components breaking, then the levering chamfer 94 enables easy removal of the second body 41 from the recess.

Locating tabs 98 are provided on the first body 40 of the lock 13 which are loosely received in locating slots 99 in the shroud 11 that extend from the recess 30. These locating features ensure that the lock 13 is correctly orientated and positioned with respect to the recess 30.

Figure 17:
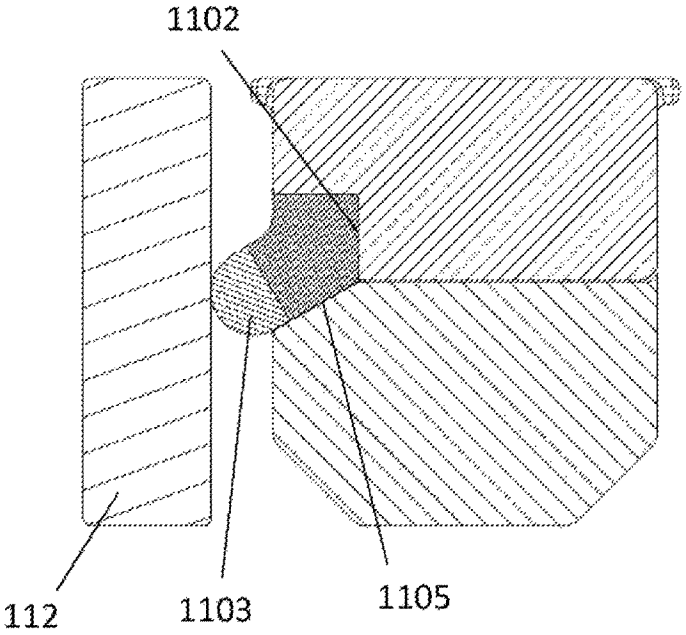
FIGS. 16 and 17 are end views of a lock assembly according to another embodiment of the present disclosure for locking a wear member to excavation equipment, the lock assembly forming a lock that is shown in a first configuration in FIG. 16 and in a second configuration in FIG. 17.
Figure 16:
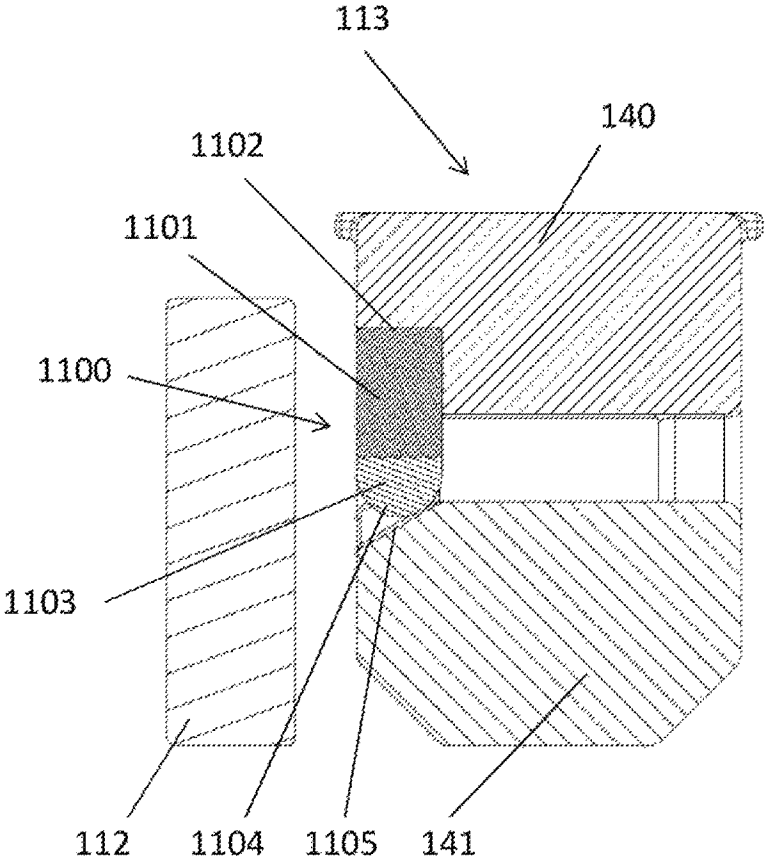

Referring to FIGS. 16 and 17, a lock 113 according to another embodiment of the present disclosure is illustrated. Similar features of the lock 113 to the lock 13 of FIGS. 8-15B have been given the same reference number, but prefixed with the numeral 1.

The lock 113 is modified from the lock 13 to include a resiliently deformable component 1100 on the first lock body 140 to provide take-up of any wear on the shroud 111 and the lip in the region of their fitment. The component

1100 comprises a deformable part in the form of an elastomeric block 1101 (although other deformable parts such as one or more springs could be incorporated) that is held within a cavity 1102 provided in the bottom corner of the first body 140. The component 1100 also comprises a rigid tab 1103 attached to the elastomeric block 1101 and having a rounded distal end 1104 from the elastomeric block. In an at rest position, the rigid tab 1103 projects beyond the bottom surface 159*a* of the first body 140 as shown in FIG. 16. The elastomeric block 1101, the cavity 1102 and the rigid tab 1103 extend longitudinally along a substantial portion of the length of the first body 140.

The second body 141 is provided with a ramp surface 1105 extending longitudinally on an upper corner such that when the lock 113 is in its assembled condition, the ramp surface 1105 partly faces the deformable component 1100. The deformable component 1100, specifically its rigid tab 1103, begins to contact the ramp surface 1105 as the lock is adjusted from its first configuration to its second configuration, causing the elastomeric block 1101 to deform. The ramp surface 1105 causes the rigid tab 1103 to deflect out to the side of the lock 113 as the lock is brought into its second configuration and into engagement with the boss 112. This engagement with the boss 112 provides the take-up by producing a biasing force on the shroud 111 to draw the shroud further onto the lip of the excavation equipment. Because of the resilient nature of the elastomeric block 1101, the deformable component 1100 is biased towards its at rest state which provides take-up as the bodies 140, 141 wear during use.

Although the embodiment shown in FIGS. 16 and 17 show the deformable component 1100 being located on the side of the lock 113 near to the boss 112, it could in other embodiments be provided on the other side of the lock or both sides. Also, in other embodiments, the deformable component could be provided on the second body and the ramp surface provided on the first body of the lock. Take-up may also be provided by any other suitable arrangement.

Figures 18A, 18B:
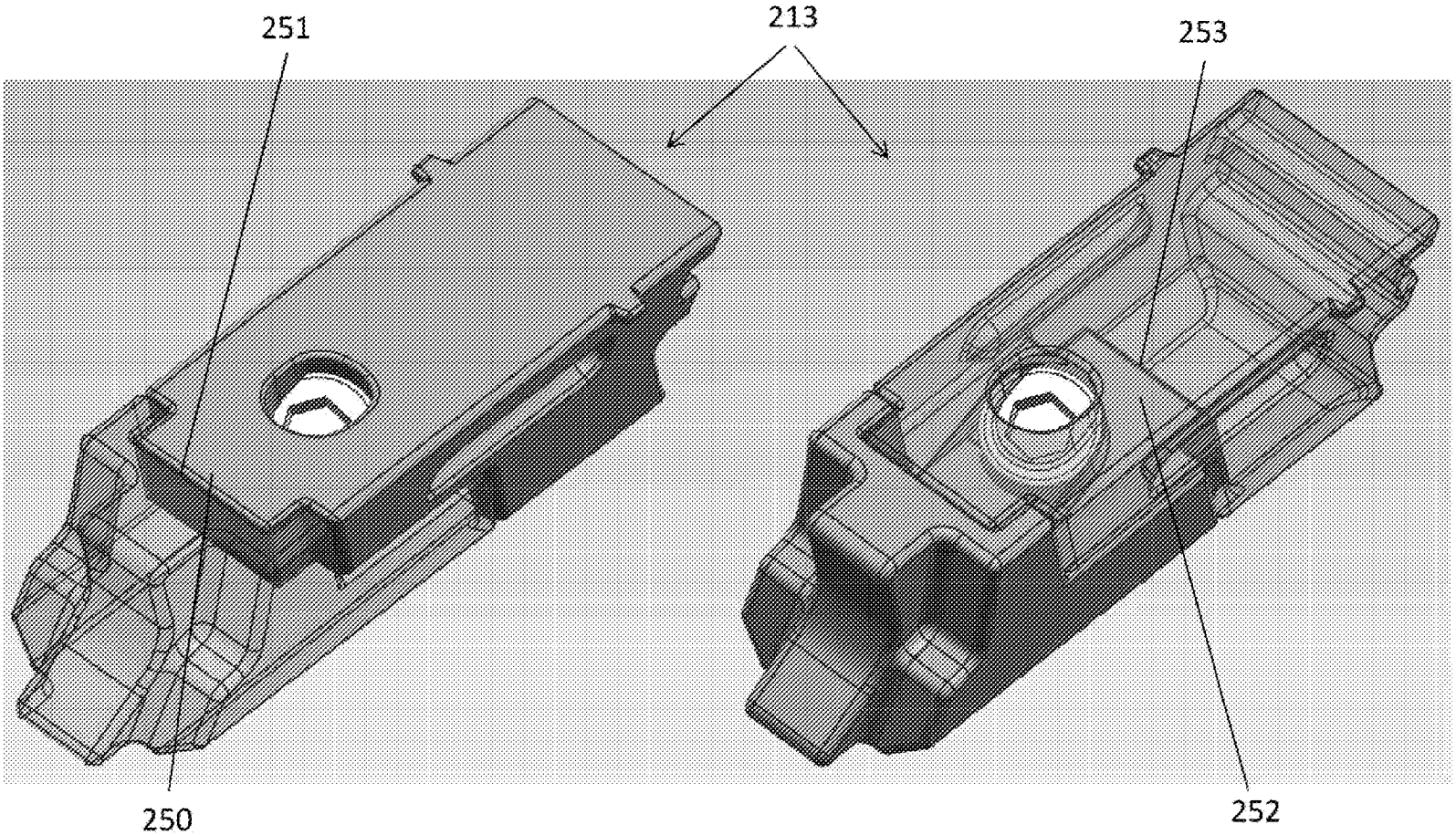
FIGS. 18A and 18B are top perspective views of a lock assembly according to another embodiment of the present disclosure for locking a wear member to excavation equipment, with the second and first bodies respectively shown in outline and with the lock in a second, collapsed, configuration. The lock could be used as the lock in the wear assembly of FIG. 1.
Figure 19:
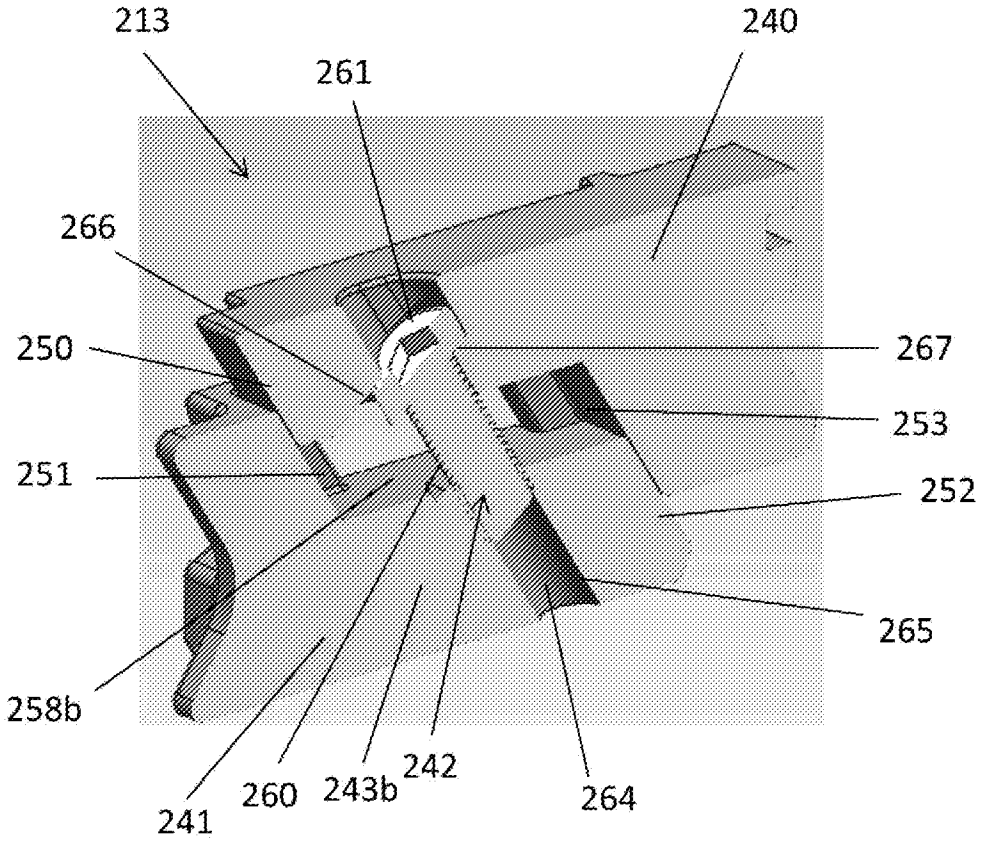
FIG. 19 is a cross-sectional view of the lock of FIGS. 18A and 18B.

Referring now to FIGS. 18A, 18B and 19, a lock 213 according to another embodiment of the present disclosure is illustrated. Similar features of the lock 213 to the lock 13 of FIGS. 8-15B have been given the same reference number, but prefixed with the numeral 2. The lock 213 can also be incorporated into the wear assembly 10 with the shroud 11 and the boss 12.

The lock 213 differs from the lock 13 in that the side surfaces of the interengaging tongues and grooves 250-253 are substantially parallel to each other. Thus the tongues and grooves of the lock 213 do not taper. As a result the lock 213 of Figures can be assembled in a different manner to the lock 13.

Assembly of the lock 213 comprises first engaging the threaded shank portion 260 of the adjustment member 242 with the threaded internal surface 265 of the second cavity portion 264 in the second body 241. This involves only partly screwing the threaded shank portion 260 into the second cavity portion 264 so that the majority of the adjustment member 242 projects out of the upper surface 258*b* of the second body's elongate portion 243*b*. The first body 240 then slides over the assembled adjustment member 242 and second body 241 such that the head portion 261 of the adjustment member 242 is received between the bearing surfaces 266, 267 that are formed in the first body 240. In this motion, the tongue 250 on the first body 240 is received in the groove 251 in the second body 241 and the groove 253 on the first body is received over the tongue 252 on the second body.

Although all of the above embodiments discussed with respect to FIGS. 1-19 have described a lock and locking arrangement being used to lock a shroud to the lip of excavation equipment, it is to be appreciated that the lock according to any one or more of these embodiments could also be used to lock other wear members to excavation equipment. For example, the lock could be used to lock adapters of excavation teeth to the lip of excavation equipment or it could be used to lock points to adapters in an excavation tooth assembly. In such embodiments, the wear assembly may not include a boss. For example, the lock might be positioned between surfaces of the point and the adapter to hold the point to the adapter.

In the claims which follow and in the preceding disclosure, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the present disclosure.

Accordingly, the present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods which can, of course, vary. It is also to be understood that the terminology used herein is for the purpose of describing particular embodiments only, and is not intended to be limiting.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

The invention claimed is:

1. A lock assembly for locking a wear member to excavation equipment, the assembly comprising first and second bodies configured to be assembled together in an assembled condition to form a lock, the lock being elongated in a direction of a longitudinal axis of the lock, the lock being adjustable between first and second configurations of the first and second bodies, wherein adjustment of the lock from the first configuration to the second configuration comprises translation of the first body with respect to the second body along a translation axis that is transverse to the longitudinal axis of the lock to extend the lock in the direction of the lock's longitudinal axis.

2. The lock assembly of claim 1, wherein the first and second bodies each comprise an elongate portion having first and second ends that in the assembled condition of the lock are spaced apart in the direction of the lock's longitudinal axis, and a foot portion that extends from the first end of the elongate portion, transverse to the longitudinal axis of the lock, and wherein the assembled condition one body is positioned over the other body with the respective elongate portions in opposing relation.

3. The lock assembly according to claim 2, wherein an inwardly facing surface of each foot portion is in opposed facing relation with an outwardly facing surface at the second end of the elongate portion of the other of the first or second body and wherein there is relative sliding movement between the opposed surfaces on adjustment of the lock between the first and second conditions.

4. A lock assembly as claimed in claim 3, wherein at least one of the opposing surfaces comprise interengaging formations configured to interengage when the bodies are in the assembled condition to form at least one coupling that resists relative lateral displacement of the bodies.

5. A lock assembly as claimed in claim 4, wherein at least one of the at least one coupling formed in the assembled lock is in the form of a tongue and groove connection.

6. A lock assembly as claimed in claim 5, wherein each tongue widens as it extends away from its respective body and each groove widens as it extends into its respective body.

7. A lock assembly as claimed in claim 5, wherein the assembled lock has first and second said couplings located on respective ones of the opposed surfaces.

8. A lock assembly as claimed in claim 2, wherein the lock also comprises an adjustment member operable to move the first body relative to the second body between the first and second configurations.

9. A lock assembly as claimed in claim 8, wherein the adjustment member is operable to be rotated to cause translation of the first body relative to the second body.

10. A lock assembly as claimed in claim 9, wherein the adjustment member is in threaded engagement with one of the first or second bodies to drive movement of the bodies between the first and second configurations.

11. A lock assembly as claimed in claim 1, wherein a surface indicator is provided on one or both of the first and second bodies for indicating when the lock is in its first configuration.

12. A lock assembly as claimed claim 1, wherein each of the lock bodies has a leverage surface for leveraging the lock body independently of the other lock body out of a recess in the wear member, in which the lock is received to lock the wear member to the excavation equipment.

13. The lock assembly according to claim 2, wherein in the first configuration the elongate portions of the first and second bodies are spaced from one another and in the second configuration and move towards each other as the lock is adjusted to the second position.

14. The lock assembly as claimed in claim 2, wherein an outwardly facing surface of the foot portions have engaging structures which are configured to engage with a complementary structure of the wear member or excavation equipment when the lock is adjusted into its second configuration.

15. A wear assembly for attachment to excavation equipment comprising:

a wear member extending along a longitudinal axis between a forward portion and a rearward mounting portion, the wear member having a recess for receiving a lock; and a lock assembly for locking a wear member to excavation equipment, the lock assembly comprising first and second bodies configured to be assembled together in an assembled condition to form a lock extending along a longitudinal axis, the lock being adjustable from the first configuration to the second configuration of the first and second bodies, wherein adjustment of the lock from the first to the second configuration comprises the first body moving with respect to the second body to extend the lock in the direction of the lock's longitudinal axis wherein adjustment of the lock between first and second configurations comprises translation of the first body with respect to the second body along a translation axis that is transverse to the longitudinal axis of the lock, said adjustment of the lock to the second configuration causing the wear member to be locked to the excavation equipment when the lock is located in the recess of the wear member.

16. The wear assembly according to claim 15, wherein the lock has engaging structures at opposite ends which engage with engaging structures at opposing ends of a recess when the lock is adjusted into its second configuration, the engagement of respective engaging structures holding the lock in the recess.

17. The wear assembly according to claim 16, wherein each of the engaging structures comprise shoulder formations that interfit with the opposing engaging structure of the recess.

18. A lock assembly for locking a wear member to excavation equipment, the assembly comprising first and second bodies configured to be assembled together in an assembled condition to form a lock extending along a longitudinal axis, the lock being adjustable between first and second configurations of the first and second bodies, wherein adjustment of the lock from the first configuration to the second configuration comprises translation of the first body with respect to the second body along a translation axis that is transverse to the longitudinal axis of the lock to extend the lock in the direction of the lock's longitudinal axis;

the first and second bodies each comprise an elongate portion having first and second ends that in the assembled condition of the lock are spaced apart in the direction of the lock's longitudinal axis, and a foot portion that extends from the first end of the elongate portion, transverse to the longitudinal axis of the lock, and wherein in the assembled condition one body is positioned over the other body with the respective elongate portions in opposing relation; an inwardly facing surface of each foot portion being in opposed facing relation with an outwardly facing surface at the second end of the elongate portion of the other of the first or second body and wherein there is relative sliding movement between the opposed surfaces on adjustment of the lock between the first and second conditions.

19. The lock assembly as claimed in claim 18, wherein the lock also comprises an adjustment member operable to move the first body relative to the second body between the first and second configurations, the adjustment member being in engagement with the elongate portions of the first and second bodies and disposed to extend between respective ones of the opposing surfaces.

20. A lock assembly for locking a wear member to excavation equipment, the assembly comprising first and second bodies configured to be assembled together in an assembled condition to form a lock extending along a longitudinal axis, the lock being adjustable between first and second configurations of the first and second bodies, wherein adjustment of the lock from the first configuration to the second configuration comprises translation of the first body with respect to the second body along a translation axis that is transverse to the longitudinal axis of the lock to extend the lock in the direction of the lock's longitudinal axis; wherein an outwardly facing surface of the respective bodies have engaging structures which are configured to engage with a complementary structure of the wear member or excavation equipment when the lock is adjusted into its second configuration.

* * * * *